US005758632A

United States Patent [19]

Yamashita et al.

[11] Patent Number: 5,758,632

[45] Date of Patent: Jun. 2, 1998

[54] DIAGNOSTIC APPARATUS FOR AIR-FUEL RATIO SENSOR

[75] Inventors: Yukihiro Yamashita; Hisashi Iida, both of Kariya; Yasuo Sagisaka, Komaki, all of Japan

[73] Assignee: Nippondenso Co., Ltd., Kariya, Japan

[21] Appl. No.: 623,787

[22] Filed: Mar. 29, 1996

[30] Foreign Application Priority Data

Mar. 31, 1995 [JP] Japan ..... 7-076336
Apr. 14, 1995 [JP] Japan ..... 7-089651

[51] Int. Cl.[6] ..... F07D 41/14

[52] U.S. Cl. ..... 123/688; 73/118.1

[58] Field of Search ..... 123/479, 688; 73/23.32, 118.1; 204/401

[56] References Cited

U.S. PATENT DOCUMENTS

| | | | |
|---|---|---|---|
| 4,724,814 | 2/1988 | Mieno et al. | 123/479 |
| 4,915,081 | 4/1990 | Fujimoto et al. | 123/688 X |
| 5,058,556 | 10/1991 | Fukuma et al. | 123/688 X |

FOREIGN PATENT DOCUMENTS

| | | |
|---|---|---|
| 61-200348 | 9/1986 | Japan . |
| 62-32237 | 2/1987 | Japan . |
| 1-110853 | 4/1989 | Japan . |
| 2-122140 | 10/1990 | Japan . |
| 4-109051 | 4/1992 | Japan . |
| 4-365952 | 12/1992 | Japan . |

*Primary Examiner*—Tony M. Argenbright
*Attorney, Agent, or Firm*—Cushman, Darby & Cushman IP Group of Pillsbury Madison & Sutro LLP

[57] ABSTRACT

The fuel ratio control system controls the supply of fuel to an internal combustion engine to achieve a target air-fuel ratio, based on the output of an air-fuel ratio sensor. The system may determine whether there is an abnormality in the air-fuel ratio sensor based on a comparison between a change of an air-fuel ratio correction coefficient, used to drive the air-fuel ratio to the target value, and a change of the target air-fuel ratio if the target air-fuel ratio has sharply changed. Alternatively, the diagnosis operation may be performed based on a comparison between a total air-fuel ratio correction amount and a change of the air-fuel ratio detected by the air-fuel ratio sensor, a phase difference calculation between peaks of the air-fuel ratio or the air-fuel ratio correction coefficent, or by accumulating the differences between the air-fuel ratio and the target air-fuel ratio, and the differences between the air-fuel ratio correction coefficient and a reference value, and comparing the accumulated values. In addition, the system may detect a sensor abnormality based on the deviation in phase of the air-fuel ratio from the air-fuel ratio correction coefficient. These system may also detect sensor abnormality on the basis of the behavior of the air-fuel ratio during transitional engine operation. As a result, the air-fuel ratio control system will not use an imprecise output from the sensor for air-fuel ratio control, thus achieving highly precise and highly reliable air-fuel ratio control.

5 Claims, 26 Drawing Sheets t1
t2
t3

TARGET A/F RATIO λTG
L
R
ΔλTG

A/F RATIO CORR. COEFF. FAF
H
L
FAFBF
ΔFAF

A/F RATIO λ
L
R

COUNTER CT1
H
0
KCT1

COUNTER CT2
H
0
KCT2
TIME

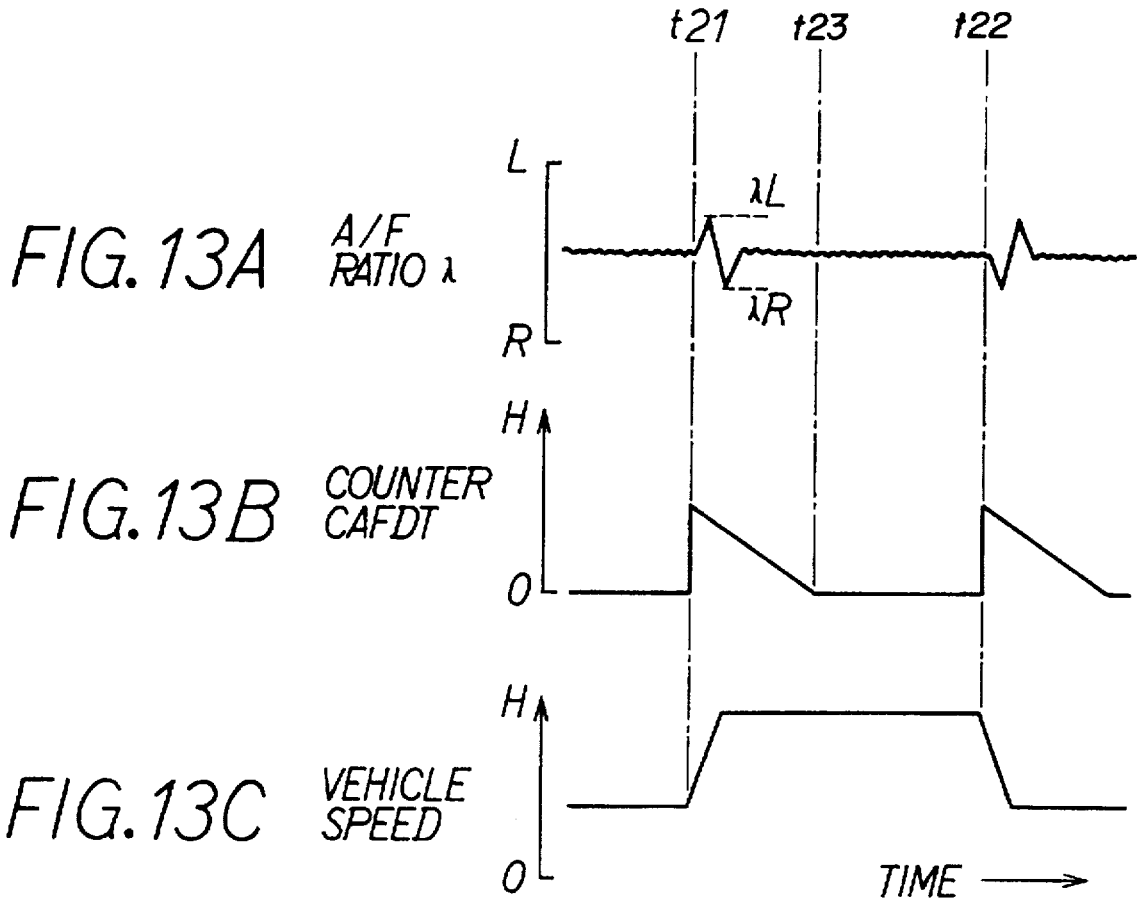
FIG. 13A
FIG. 13B
FIG. 13C
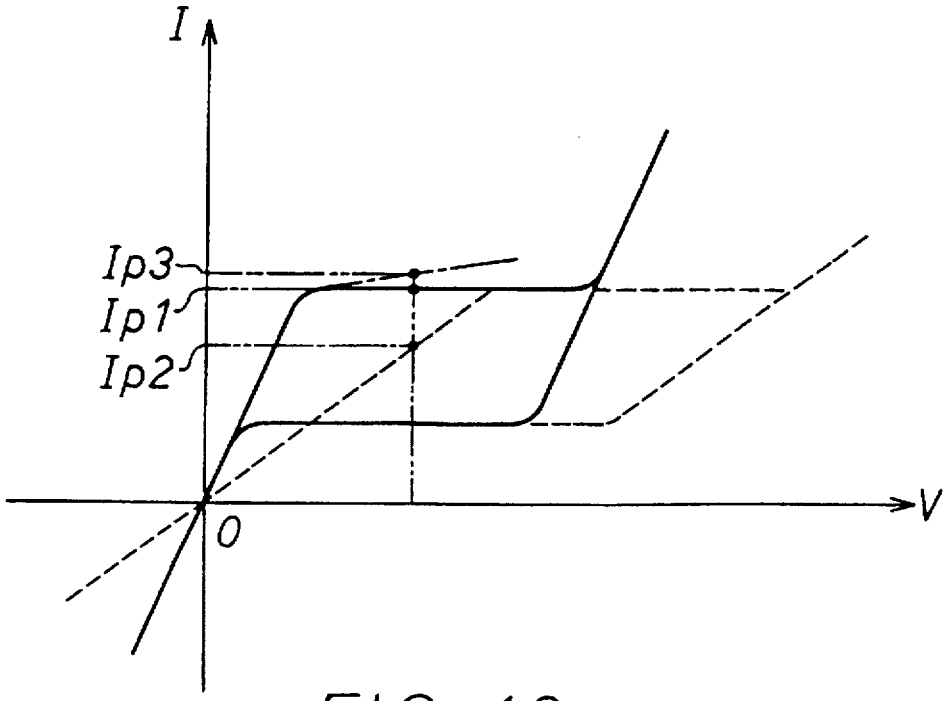
FIG. 16

L
λ 1.0
R

R
FAF 1.0
L

H
CDG1
0

H
CAF1
0

H
CAF2
0

DIAGNOSTIC APPARATUS FOR AIR-FUEL RATIO SENSOR

BACKGROUND OF THE INVENTION

1. Field of the Invention

The present invention relates to a diagnostic apparatus for an air-fuel ratio sensor that varies its output linearly with the air-fuel ratio of an internal combustion engine.

2. Description of the Related Art

Many modern air-fuel ratio control systems use air-fuel ratio sensors (for example, limit current-type oxygen sensors) that detect the air-fuel ratio and generate an output which varies linearly with the oxygen concentration in exhaust gas. In such a system, the air-fuel ratio detected by the air-fuel ratio sensor is inputted to a microcomputer to control the amount of fuel to be injected in the engine. More specifically, the microcomputer calculates an air-fuel ratio correction coefficient based on the air-fuel ratio detected by the sensor, and uses the air-fuel ratio correction coefficient to correct the amount of fuel to be injected. The control system thereby achieves optimal combustion in the internal combustion engine and reduces harmful substances in exhaust gas, such as CO, HC, NOx and the like.

However, since the control precision of the air-fuel ratio control systems is heavily degraded if the reliability of detection of the air-fuel ratio deteriorates, there has been a strong demand for a technology that precisely detects an abnormality of an air-fuel ratio sensor. For example, Japanese Unexamined Patent Application Publication No. Sho. 62-225943 discloses a diagnosis procedure to detect an abnormality in the connection system of a limit current-type oxygen sensor in accordance with the applied voltage and the detected current.

SUMMARY OF THE INVENTION

In view of the above-described problems of the prior art, it is an object of the present invention to provide an air-fuel ratio control system employing an air-fuel ratio sensor which will not use an imprecise output from the sensor, thus achieving highly precise and highly reliable air-fuel ratio control.

This goal is achieved according to a first aspect of the present invention by providing an air-fuel ratio controller which includes, in addition to a basic air-fuel ratio control apparatus using an air-fuel ratio sensor, fuel correction determining means for determining that an instruction to provide an air-fuel ratio correction amount that exceeds a predetermined amount in accordance with a change of the operating conditions of an engine to which the controller is connected has been outputted with respect to a basic fuel supply amount calculated by the basic air-fuel ratio control apparatus, and sensor diagnostic means for, if the fuel correction determining means determines that an instruction to provide an air-fuel ratio correction amount that exceeds a predetermined amount in accordance with a change of the operating conditions of the engine has been outputted with respect to the basic fuel supply amount, checking for an abnormality of the air-fuel ratio sensor by comparing a change of the target air-fuel ratio and a change of the air-fuel ratio correction amount.

In this way, the system determines whether there is a need to output a correction instruction, and determines whether there is an abnormality in the air-fuel ratio sensor based on the comparison between the change of the air-fuel ratio correction coefficient and the change of the target air-fuel ratio if the target air-fuel ratio has sharply changed. This diagnosis operation can precisely and easily detect the occurrence of an abnormality in the air-fuel ratio sensor. As a result, the air-fuel ratio control system will not use an imprecise output from the sensor for air-fuel ratio control, thus achieving highly precise and highly reliable air-fuel ratio control.

The above object is achieved according to a second aspect of the present invention by providing an air-fuel ratio control system similar to the one described above in which the system determines whether there is abnormality in the air-fuel ratio sensor based on a comparison between a total correction amount and the change of the air-fuel ratio detected by the air-fuel ratio sensor, thereby providing similar advantageous effects.

The above object is achieved according to a third aspect of the present invention by providing an air-fuel ratio control system similar to the one described above in which the diagnosis operation is performed based on a phase difference calculation between peaks of the air-fuel ratio or the air-fuel ratio correction coefficent. In this way, the system executes precise diagnosis even if the amplitude center of the air-fuel ratio or the air-fuel ratio correction coefficient shifts to the lean or rich side to a large extent.

In addition, the system may include means to learn an air-fuel ratio correction amount, and if the result of this learning is reflected in the air-fuel ratio control, the amplitude center of the air-fuel ratio correction coefficient is shifted from a reference value. In such cases, the phase of the output from the sensor and/or the air-fuel ratio correction coefficient can be precisely determined without being affected by the lean burn or the air-fuel ratio learning by calculating the phase based on the interval between the peaks. Thus, the system performs appropriate diagnosis operations.

The above object is achieved according to a fourth aspect of the present invention by providing an air-fuel ratio control system similar to the one described above in which the system determines the occurrence of a sensor abnormality by accumulating differences between the air-fuel ratio and the target air-fuel ratio and the differences between the air-fuel ratio correction coefficient and a reference value, and comparing the accumulated values. The diagnosis based on such accumulations makes it possible to perform a diagnosis that is hardly affected by external disturbances, such as temporary fluctuations of the sensor output or correction coefficients.

The above object is achieved according to a fifth aspect of the present invention by providing an air-fuel ratio control system similar to the one described above in which the system performs sensor diagnosis based on the deviation in phase of the air-fuel ratio from the air-fuel ratio correction coefficient. In this way, similarly beneficial results are obtained.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which:

FIGS. 8, 8A and 8B are flowcharts of a sensor diagnosis routine according to the first embodiment;

FIGS. 13A–13C are timing charts illustrating the diagnosis operation according to a third embodiment of the present invention;

FIG. 16 is a voltage-current characteristic diagram illustrating the output from the air-fuel ratio sensor when the sensor has abnormality;

FIGS. 28, 28A and 28B are flowcharts illustrating a phase deviation determination routine according to a fourth embodiment of the present invention.

DETAILED DESCRIPTION OF THE PRESENTLY PREFERRED EXEMPLARY EMBODIMENTS

A first preferred embodiment of an air-fuel ratio control system for an internal combustion engine of the present invention will be described hereinafter.

Figure 1:
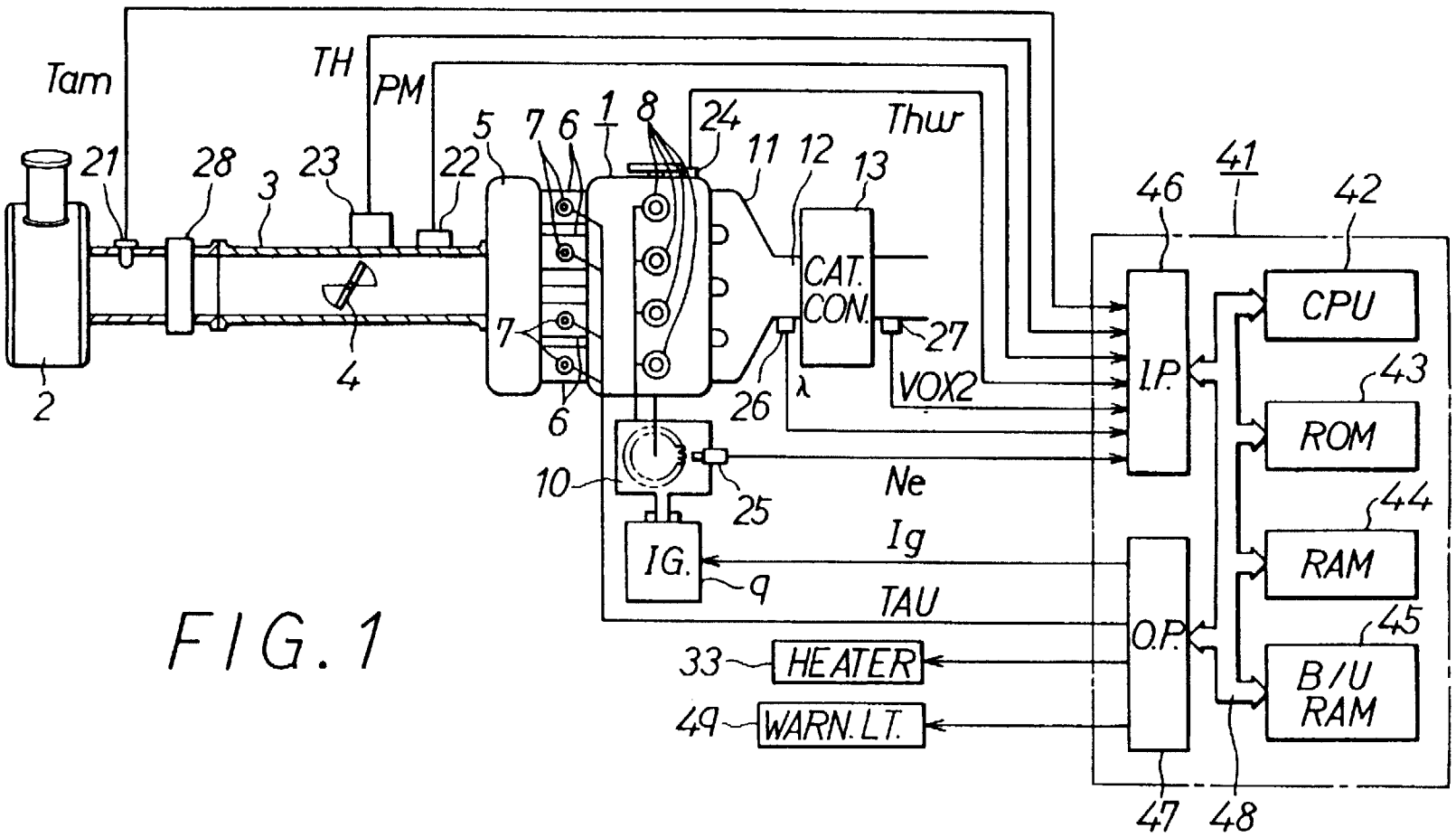
FIG. 1 illustrates the overall construction of an air-fuel ratio control apparatus for an internal combustion engine according to a first embodiment of the present invention.

FIG. 1 schematically illustrates an arrangement of an internal combustion engine and its peripheral devices according to the first embodiment. An internal combustion engine 1 is, for example, a spark ignition type 4-cylinder 4-stroke engine. Intake air flows through an air cleaner 2, an intake pipe 3, a throttle valve 4, a surge tank 5 and an intake manifold 6. The intake air in the intake manifold 6 is mixed with the fuel injected from fuel injection valves 7. The mixture having a predetermined air-fuel ratio is then supplied into a corresponding one of the cylinders of the engine 1. According to this embodiment, the fuel injection valves 7 act as fuel supplying means as recited in the appended claims.

Spark plugs 8 are provided separately for each cylinder. Receiving a high voltage that is supplied from an ignition circuit 9 and distributed by a distributor 10, each spark plug 8 ignites the mixture in its corresponding cylinder at predetermined timing. The exhaust gas from the cylinder is forced out into an exhaust manifold 11, and then to an exhaust pipe 12 in which harmful substances (such as CO, HC, NOx and the like) are removed by a three-way catalytic converter 13 provided therein. The exhaust gas is then let out to the atmosphere.

The intake pipe 3 is provided with an intake air temperature sensor 21 and an intake air pressure sensor 22. The intake air temperature sensor 21 detects the temperature of intake air (intake air temperature Tam) upstream of the throttle valve 4, and the intake air pressure sensor 22 detects the pressure of intake air (intake air pressure PM) downstream from the throttle valve 4. The throttle valve 4 is provided with a throttle sensor 23 for detecting the opening degree of the valve 4 (throttle opening TH). The throttle sensor 23 outputs analog signals in accordance with the throttle opening TH and also a separate signal indicating substantially complete closure of the valve 4. A cylinder block of the internal combustion engine 1 is provided with a coolant temperature sensor 24 for detecting the temperature of the coolant in the engine 1 (coolant temperature Thw). The distributor 10 employs a rotational speed sensor 25 to detect the rotational speed of the internal combustion engine 1 (engine speed Ne). The rotational speed sensor 25 outputs twenty-four signal pulses regularly for two revolutions, that is, every 720° CA, of the engine 1.

An air-fuel ratio sensor 26 is provided upstream from the three-way catalytic converter 13 in the exhaust pipe 12. The air-fuel ratio sensor 26 is constituted by a limit current type oxygen sensor that outputs linear air-fuel ratio signals varying proportionally with the oxygen concentration in exhaust gas over a wide range. Provided downstream from the three-way catalytic converter 13 is a downstream $O_2$ sensor 27 that outputs a signal VOX2 in accordance with the air-fuel ratio, that is, depending on whether the mixture is rich or lean, with reference to the theoretical air-fuel ratio ($\lambda=1$). According to this embodiment, the air-fuel ratio is expressed by "$\lambda$" with the stoichiometric air-fuel ratio (14.7:1) being expressed as $\lambda=1$.

Figure 2:
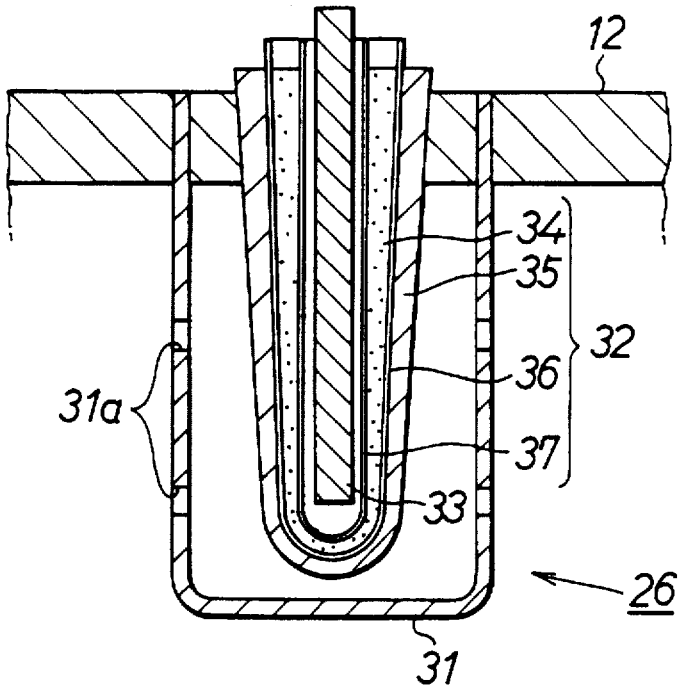
FIG. 2 is a detailed sectional view of an air-fuel ratio sensor.

FIG. 2 is a schematic cross-sectional view of the air-fuel ratio sensor 26. The air-fuel ratio sensor 26 projects into the interior of the exhaust pipe 12 through its wall and comprises a cover 31, a sensor body 32 and a heater 33. The cover 31 has a generally "U" shaped longitudinal cross-section, and the peripheral wall of the cover 31 has many pores 31*a* that connect the inside of the cover 31 with the outside thereof. The sensor body 32 generates a limit current in accordance with either the concentration of oxygen within a lean region of the air-fuel ratio of the mixture or the concentration of carbon monoxide (CO) within a rich region of the air-fuel ratio of the mixture.

The heater 33 is disposed in a space surrounded by an atmosphere-side electrode layer 37. The heat energy from the heater 33 heats the sensor body 32 (including the atmosphere-side electrode layer 37, a solid electrolyte layer 34, an exhaust gas-side electrode layer 36 and a diffused resistor layer 35). The heater 33 has a sufficient heat generating capacity to activate the sensor body 32.

With this construction of the air-fuel ratio sensor 26, the sensor body 32 generates a variable voltage at the point of the theoretical air-fuel ratio, and produces a limit current in accordance with the oxygen concentration within the lean region defined with respect to the theoretical air-fuel ratio. The limit current in accordance with the oxygen concentration varies depending on the area of the exhaust gas-side electrode layer 36, the thickness of the diffused resistor layer 35, and the porosity and the average pore size of the cover 31. The sensor body 32 linearly detects the oxygen concentration, i.e., its output varies linearly with respect to the oxygen concentration. However, since a high temperature of about 650° C. or higher is needed to activate the sensor body 32 and the activation temperature range of the sensor body 32 is relatively narrow, the thermal energy from exhaust gas from the engine 1 is not sufficient to ensure the activation of the sensor body 32. According to this embodiment, the heater 33 is controlled by an ECU 41 to maintain the sensor body 32 at a predetermined activation temperature. Within a rich region with respect to the theoretical air-fuel ratio, on the other hand, the concentration of carbon monoxide (CO), that is, an unburned gas, varies substantially linearly with the air-fuel ratio. The sensor body 32 generates a limit current in accordance with the CO concentration in the rich region.

The voltage-current characteristics of the sensor body 32 will be described with reference to FIG. 3. The current-voltage characteristic curves in FIG. 3 indicate that the current flowing into the solid electrolyte layer 34 of the sensor body 32 in proportion to the oxygen concentration (air-fuel ratio) detected by the air-fuel ratio sensor 26 is linear with respect to the voltage applied to the solid electrolyte layer 34. When the sensor body 32 is in the activated state at a temperature T=T1, the current-voltage characteristics of the sensor body 32 exhibit a stable state as indicated by the characteristic curve L1 represented by solid lines in FIG. 3. The straight segments of the characteristic curve L1 parallel to the voltage axis V specify limit currents occurring in the sensor body 32. The variation of the limit current corresponds to the variation of the air-fuel ratio (that is, lean or rich). More precisely, the limit current increases as the air-fuel ratio shifts further to the lean side, and the limit current decreases as the air-fuel ratio shifts further to the rich side.

The region of the voltage-current characteristic curve where the voltage is smaller than the levels corresponding to the straight segments parallel to the voltage axis V is a resistance-dominant region. The slope of the characteristic curve L1 within such a resistance-dominant region is determined by the internal resistance of the solid electrolyte layer 34 provided in the sensor body 32. The internal resistance of the solid electrolyte layer 34 varies with temperature. As the temperature of the sensor body 32 decreases, the resistance increases and, therefore, the slope is reduced. When the temperature T of the sensor body 32 is T2, which is lower than T1, the current-voltage characteristics of the sensor body 32 become as indicated by the characteristic curve L2 represented by broken lines in FIG. 3. The straight segments of the characteristic curve L2 parallel to the voltage axis V specify limit currents occurring in the sensor body 32. The limit currents determined by the characteristic curve L2 are substantially equal to those determined by the curve L1.

Figure 3:
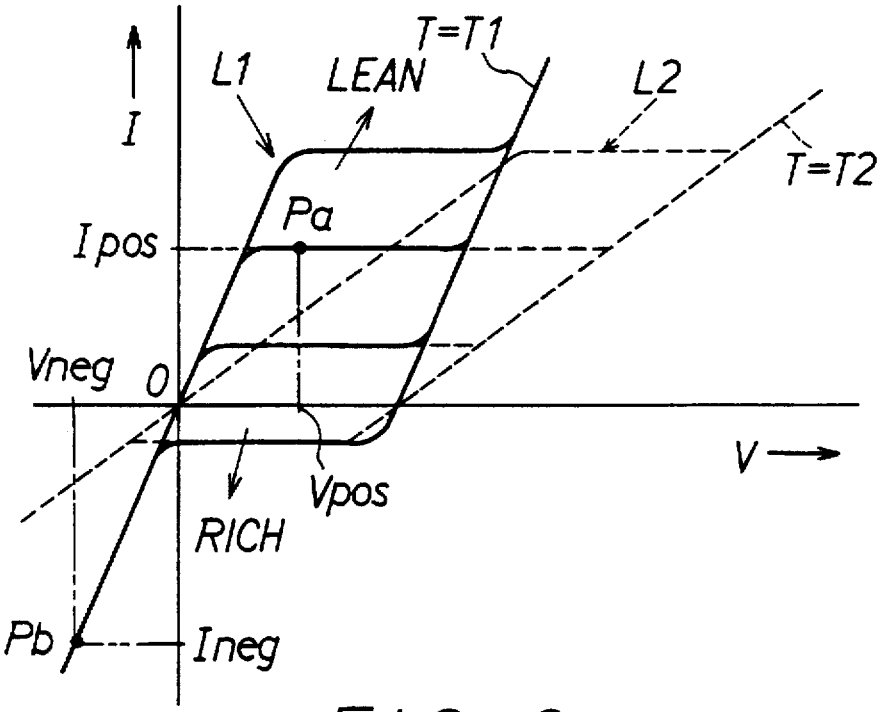
FIG. 3 is a graph indicating the voltage-current characteristics of the air-fuel ratio sensor of FIG. 2.

With the characteristic curve L1, if a positive voltage is applied to the solid electrolyte layer 34 of the sensor body 32, the current flowing through the sensor body 32 becomes a limit current Ipos (see point Pa in FIG. 3). If a negative voltage is applied to the solid electrolyte layer 34 of the sensor body 32, the current through the sensor body 32 becomes a negative limit current Ineg that is not dependent on the oxygen concentration but proportional solely to the temperature (see point Pb in FIG. 3).

An electronic control unit (hereinafter, referred to as an "ECU") 41 for controlling the operation of the internal combustion engine as shown in FIG. 1 includes a CPU (central processing unit) 42, a ROM (read only memory) 43, a RAM (random access memory) 44, a backup RAM 45 and the like. The ECU 41 is connected by a bus 28 to an input port 46 for inputting detection signals from the aforementioned sensors and an output port 47 for outputting control signals to various actuators. The ECU 41 receives signals regarding intake air temperature Tam, intake air pressure PM, throttle opening TH, coolant temperature Thw, engine speed Ne, the air-fuel ratio and the like from the sensors via the input port 46. The ECU 41 then computes control signals regarding fuel injection amount TAU, ignition timing Ig and the like based on the values indicated by the signals and outputs these control signals to the fuel injection valve 7, the ignition circuit 9 and the like via the output port 47. Further, the ECU 41 executes sensor diagnosis (described later) to determine whether there is an abnormality in the air-fuel ratio sensor 26. If there is any abnormality in the sensor 26, the ECU 41 turns on a warning light 49 to notify the driver of the abnormality that has occurred. According to this embodiment, the CPU 42 provided in the ECU 41 constitutes means for calculating a basic fuel amount, means for setting an air-fuel ratio correction amount, means for controlling the air-fuel ratio, means for determining on fuel correction, means for diagnosing the air-fuel ratio sensor, and means for setting a target air-fuel ratio as recited in the appended claims.

A procedure designed to perform air-fuel ratio control in this fuel injection control system will be described below. The following design procedure is disclosed in Japanese Unexamined Patent Application Publication No. Hei. 1-110853, incorporated herein by reference.

(1) Modeling of Control Object

This embodiment employs a recursive moving average model of the first degree incorporating a dead time P=3 as a model of the system for controlling the air-fuel ratio λ of the internal combustion engine 1 and, further, considers an external disturbance d for approximation.

The model of the system using the self-recurrent moving average model to control the air-fuel ratio λ can be approximated by Equation (1):

$$\lambda(k)=a-\lambda(k-1)+b\ -FAF(k-3) \tag{1}$$

where FAF is an air-fuel ratio correction coefficient; a, b are model constants for determining the responsiveness of the model; and k is a variable indicating the number of control operations performed after the start of the initial sampling.

Considering the external disturbance d, the control system model can then be approximated by Equation (2):

$$\lambda(k)=a-\lambda(k-1)+b\ -FAF(k-3)+d(k-1) \tag{2}$$

With the thus-approximated model, it is easy to determine the model constants a, b, that is, the transfer function of the system for controlling the air-fuel ratio λ, by discretely sampling at a revolution cycle (360° CA) using a step response.

(2) Expression of Quantity of State Variable (where X is a vector quantity)

Using state variable quantity X(k)=[X1(k), X2(k), X3(k), X4(k)]$^T$ (where T is represents a transposed matrix), Equation (2) can be rewritten into matrix Equation (3), and then into Equations (4):

$$\begin{bmatrix} X1(k+1) \\ X2(k+1) \\ X3(k+1) \\ X4(k+1) \end{bmatrix} = \begin{bmatrix} ab00 \\ 0010 \\ 0001 \\ 0000 \end{bmatrix} \begin{bmatrix} X1(k) \\ X2(k) \\ X3(k) \\ X4(k) \end{bmatrix} + \begin{bmatrix} 0 \\ 0 \\ 0 \\ 1 \end{bmatrix} FAF(k) + \begin{bmatrix} 1 \\ 0 \\ 0 \\ 0 \end{bmatrix} d(k) \quad (3)$$

$$\begin{aligned} X1(k+1) &= aX1(k) + bX2(k) + d(k) = \lambda(k+1) \\ X2(k+1) &= FAF(k-2) \\ X3(k+1) &= FAF(k-1) \\ X4(k+1) &= FAF(k) \end{aligned} \quad (4)$$

(3) Design of Regulator

When a regulator is designed based on Equations (3) and (4), the air-fuel ratio correction coefficient FAF can be expressed as in Equation (5) using optimal feedback gain K=[K1, K2, K3, K4] and state variable quantity $X^T$(k)=[λ(k), FAF(k−3), FAF(k−2), FAF(k−1)]:

$$\begin{aligned} FAF(k) &= K - X^T(k) \\ &= K1 - \lambda(k) + K2 - FAF(k-3) + K3 - FAF(k-2) + \\ &\quad K4 - FAF(k-1) \end{aligned} \quad (5)$$

By adding to Equation (5) an integration term ZI(k) for absorbing errors, the air-fuel ratio correction coefficient FAF can be provided as in Equation (6):

$$FAF(k) = K1 - \lambda(k) + K2 - FAF(k-3) + K3 - FAF(k-2) + K4 - FAF(k-1) + ZI(k) \quad (6)$$

The integration term ZI(k) is a value determined by an integration constant Ka and a difference between a target air-fuel ratio λTG and an actual air-fuel ratio λ(k), as in Equation (7):

$$ZI(k) = ZI(k-1) + Ka - (\lambda TG - \lambda(k)) \quad (7)$$

Figure 4:
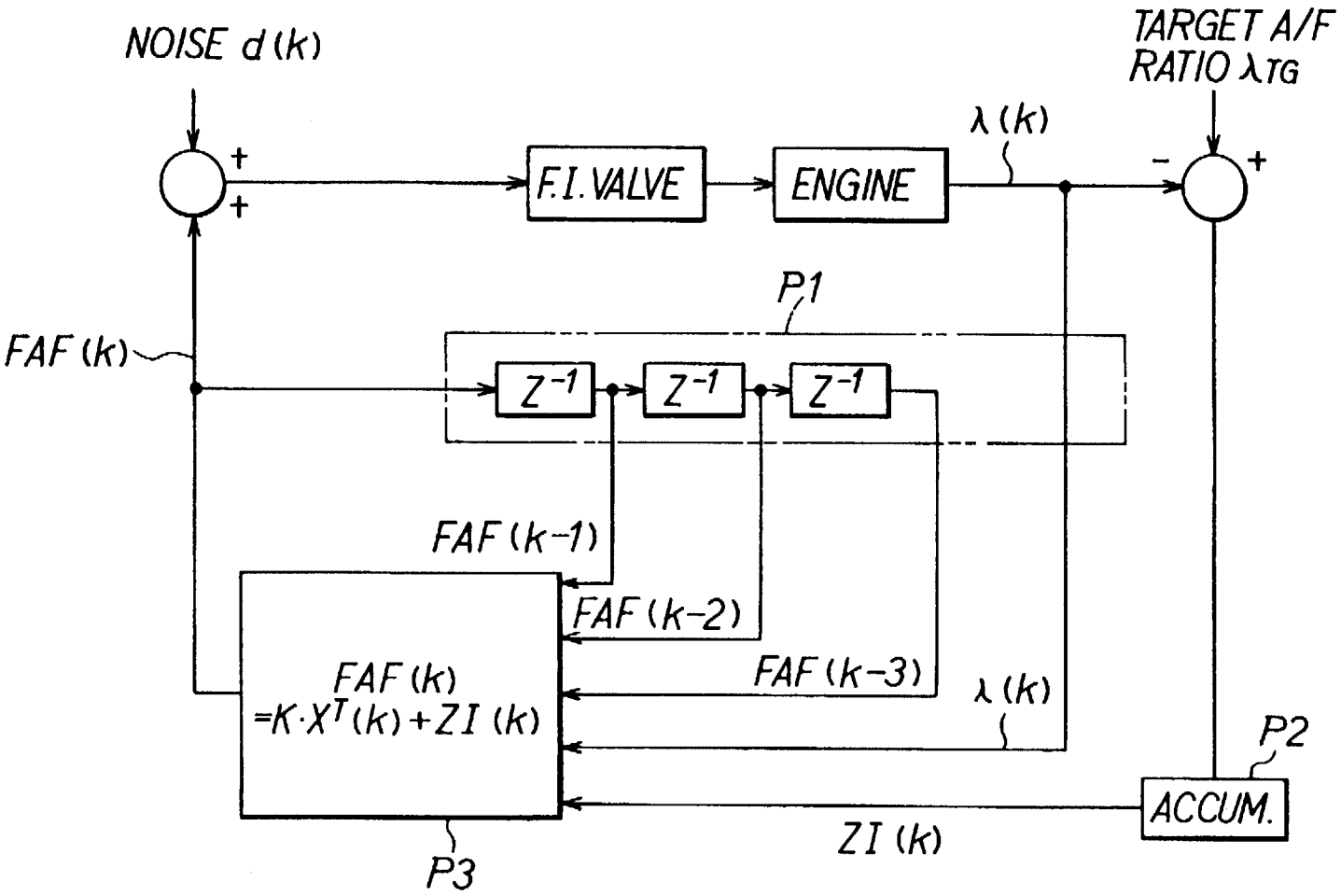
FIG. 4 is a block diagram of an air-fuel ratio control system, illustrating its operational principles.

FIG. 4 is a block diagram of an air-fuel ratio λ control system whose model has been designed as described above. The model uses an $Z^{-1}$ transformation to obtain an air-fuel ratio correction coefficient FAF(k) from FAF(k−1) as shown in FIG. 4. For this operation, the previous air-fuel ratio correction coefficient FAF(k−1) is stored in the RAM 44 and then read out at the following control timing. Incidentally, "FAF(k−1)" represents the last air-fuel ratio correction coefficient, "FAF(k−2) represents the air-fuel ratio correction coefficient immediately preceding FAF(k−1), and "FAF (k−3)" represents the air-fuel ratio correction coefficient immediately preceding FAF(k−2).

The block P1 enclosed by the two-dotted line in FIG. 4 indicates a section for determining the state variable quantity X(k) while the air-fuel ratio λ(k) is being feedback-controlled to a target air-fuel ratio λTG. The block P2 indicates a section (accumulating section) for determining the integration term ZI(k). The block P3 indicates a section for calculating a present air-fuel ratio correction coefficient FAF(k) based on the state variable quantity X(k) determined in the block P1 and the integration term ZI(k) determined in the block P2.

(4) Determination of Optimal Feedback Gain K and Integration Constant Ka

The optimal feedback gain Ka and the integration constant Ka can be determined by, for example, minimizing an evaluation function J shown by Equation (8):

$$J = \sum_{k=0}^{\infty} \{Q\lambda(k) - \lambda TG)^2 + R(FAF(k) - FAF(k-1))^2\} \quad (8)$$

The evaluation function of Equation (8) is intended to restrict the behavior of the air-fuel ratio correction coefficient FAF(k) and minimize the difference between the air-fuel ratio λ(k) and the target air-fuel ratio λTG. The weighting of the restriction on the air-fuel ratio correction coefficient FAF(k) can be adjusted by varying the weight parameters Q, R. Thus, the optimal feedback gain K and the integration constant Ka can be determined by repeating simulations with variations of the weight parameters Q, R until optimal control characteristics are obtained.

The optimal feedback gain K and the integration constant Ka are also dependent on the model constants a, b. Therefore, to secure sufficient stability (robustness) of the system despite the fluctuation (variation of parameters) of the system for controlling the actual air-fuel ratio λ, the variation of the model constants a, b must be considered to determine optimal feedback gain K and integration constant Ka. Thus, the simulation is performed taking into consideration the actually possible variation of the model constants a, b, to determine the optimal feedback gain K and the integration constant Ka that provide for sufficient stability.

For description of the embodiments, it should be assumed that (1) the modeling of the control object, (2) the expression of the quantity of state variable, (3) the design of the regulator, and (4) determination of the optimal feedback gain and the integration constant have been completed. Thus, the ECU 41 is assumed to use only Equations (6) and (7) to execute the air-fuel ratio control by the fuel injection control system.

The operation of the air-fuel ratio control apparatus according to this embodiment, constructed as described above, will now be described.

Figure 5:
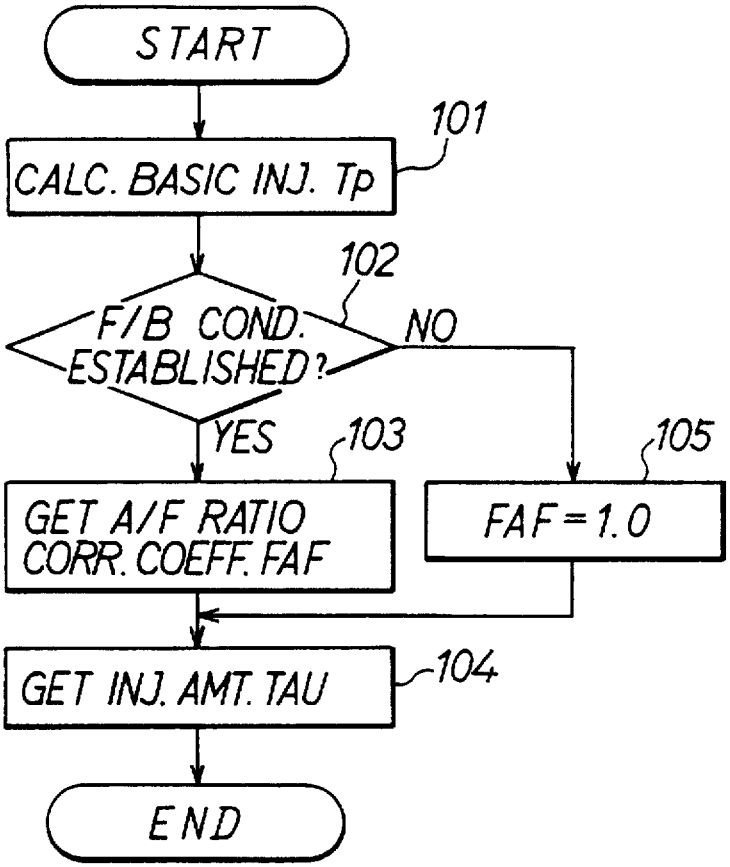
FIG. 5 is a flowchart illustrating a fuel injection amount calculating routine.

FIG. 5 shows a flowchart illustrating the fuel injection amount calculating routine executed by the CPU 42 provided in the ECU 41. This routine is executed synchronously with revolution of the internal combustion engine 1, that is, every 360° CA.

Figure 6:
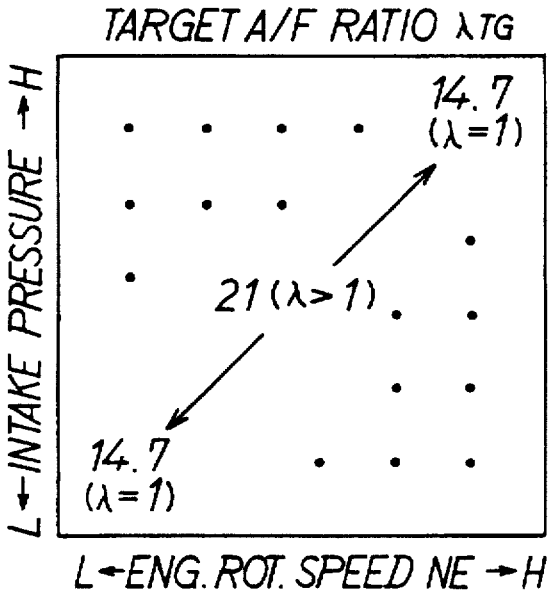
FIG. 6 illustrates a map for determining a target air-fuel ratio.
Figures 7A, 7B, 7C, 7D, 7E:
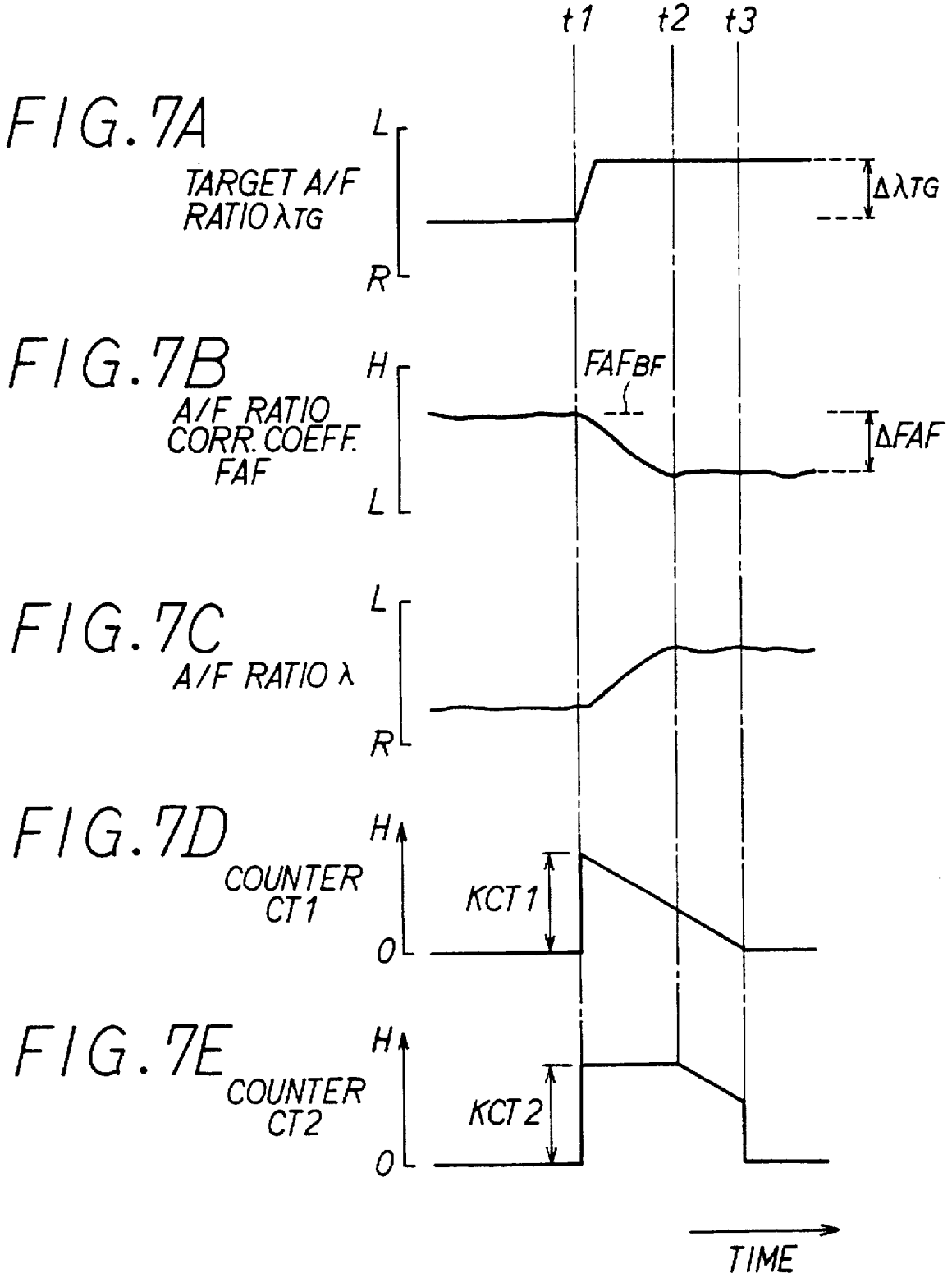
FIGS. 7A–7E are timing charts illustrating a diagnosis operation according to the first embodiment.

The CPU 42 calculates in Step 101 a basic fuel injection amount TP based on the intake air pressure PM, the engine speed Ne and the like, and in Step 102 determines whether the conditions for feedback of the air-fuel ratio λ have been established. The feedback conditions, as is well known, are established when the coolant temperature Thw equals or exceeds a predetermined temperature and the engine operation is not in a high speed region or a high load region. If the feedback conditions have been met, the CPU 42 proceeds to Step 103 to determine an air-fuel ratio correction coefficient FAF for converting the air-fuel ratio into a target air-fuel ratio λTG, and then proceeds to Step 104. More specifically, Step 103 uses Equations (6) and (7) to calculate an air-fuel ratio correction coefficient FAF based on the target air-fuel ratio λTG and the air-fuel ratio λ(k) detected by the air-fuel ratio sensor 26. The target air-fuel ratio λTG can be determined by, for example, using the map shown in FIG. 6. This map has been arranged so that the stoichiometric air-fuel ratio 14.7 (λ=1.0) is determined for both a high-load, high-speed operational range and a low-load, low-speed operational range, and such that lean air-fuel ratios (λ>1.0) are determined for the intermediate regions.

On the other hand, if Step 102 determines that the feedback conditions have not been met, the CPU 42 proceeds to Step 105 to set the air-fuel ratio correction coefficient FAF to "1.0", and then proceeds to Step 104. The air-fuel ratio correction coefficient FAF=1.0 means no correction of the air-fuel ratio λ, thus performing so-called open-loop control.

In Step 104, the CPU 42 determines a fuel injection amount TAU based on the basic fuel injection amount Tp, the air-fuel ratio correction coefficient FAF and the other correction coefficients FALL in accordance with mathematical Equation (9):

$$TAU=Tp-FAF-FALL \quad (9)$$

Then, a control signal based on the fuel injection amount TAU is outputted to the fuel injection valve 7 to control the valve opening duration and the actual fuel injection duration of the fuel injection valve 7 to force the air-fuel ratio λ to the target air-fuel ratio λTG.

The sensor diagnosis executed by the CPU 42 will be described below with reference to the timing charts shown in FIGS. 7A–7E and the flowcharts shown in FIGS. 8A and 8B.

The sensor diagnosis operation according to this embodiment will be briefly described with reference to the timing charts of FIGS. 7A–7E. When the target air-fuel ratio λTG suddenly changes to the lean side at time t1, the air-fuel ratio correction coefficient FAF varies to the quantity reduction side. As the fuel injection amount is reduced in accordance with the variation of the air-fuel ratio correction coefficient FAF, the air-fuel ratio detected by the air-fuel ratio sensor 26 changes to the lean side. Moreover, when the target air-fuel ratio λTG suddenly changes, counters CT1, CT2 are set to predetermined values KCT1, KCT2. The value of the counter CT1 is decremented as time progresses following the time point t1. The value of the counter CT2 is decremented following time point t2 at which the air-fuel ratio correction coefficient FAF converges to a predetermined value. At time point t3 when the value of the counter CT1 reaches 0, the CPU 42 performs diagnosis on the basis of a determination of whether the ratio between a change ΔλTG of the target air-fuel ratio λTG and a change ΔFAF of the air-fuel ratio correction coefficient FAF is within a predetermined range.

Since the air-fuel ratio correction coefficient FAF is determined to make the actual air-fuel ratio correspond to the target air-fuel ratio λTG, the air-fuel ratio correction coefficient FAF varies in accordance with the change ΔλTG of the target air-fuel ratio λTG. If the air-fuel ratio sensor 26 has no abnormality, the output from the sensor 26 corresponds to the variation of the target air-fuel ratio λTG (that is, the output corresponds to the air-fuel ratio) and, based on such output, an appropriate air-fuel ratio correction coefficient FAF for achieving the target air-fuel ratio λTG can be set. If the air-fuel ratio sensor 26 has an abnormality, the output from the sensor 26 does not correspond to the target air-fuel ratio λTG and, accordingly, an appropriate air-fuel ratio correction coefficient FAF cannot be set. In this case, it is determined that an abnormality has occurred in the sensor 26.

Figure 9:
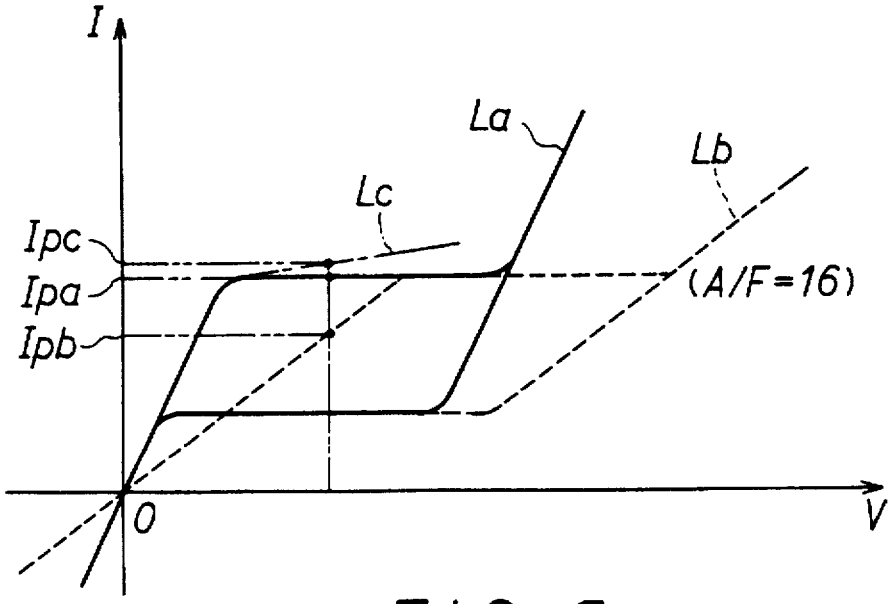
FIG. 9 is a voltage-current characteristic diagram illustrating the output from the air-fuel ratio sensor when the sensor has an abnormality.
Figures 10A, 10B, 10C, 10D, 10E:
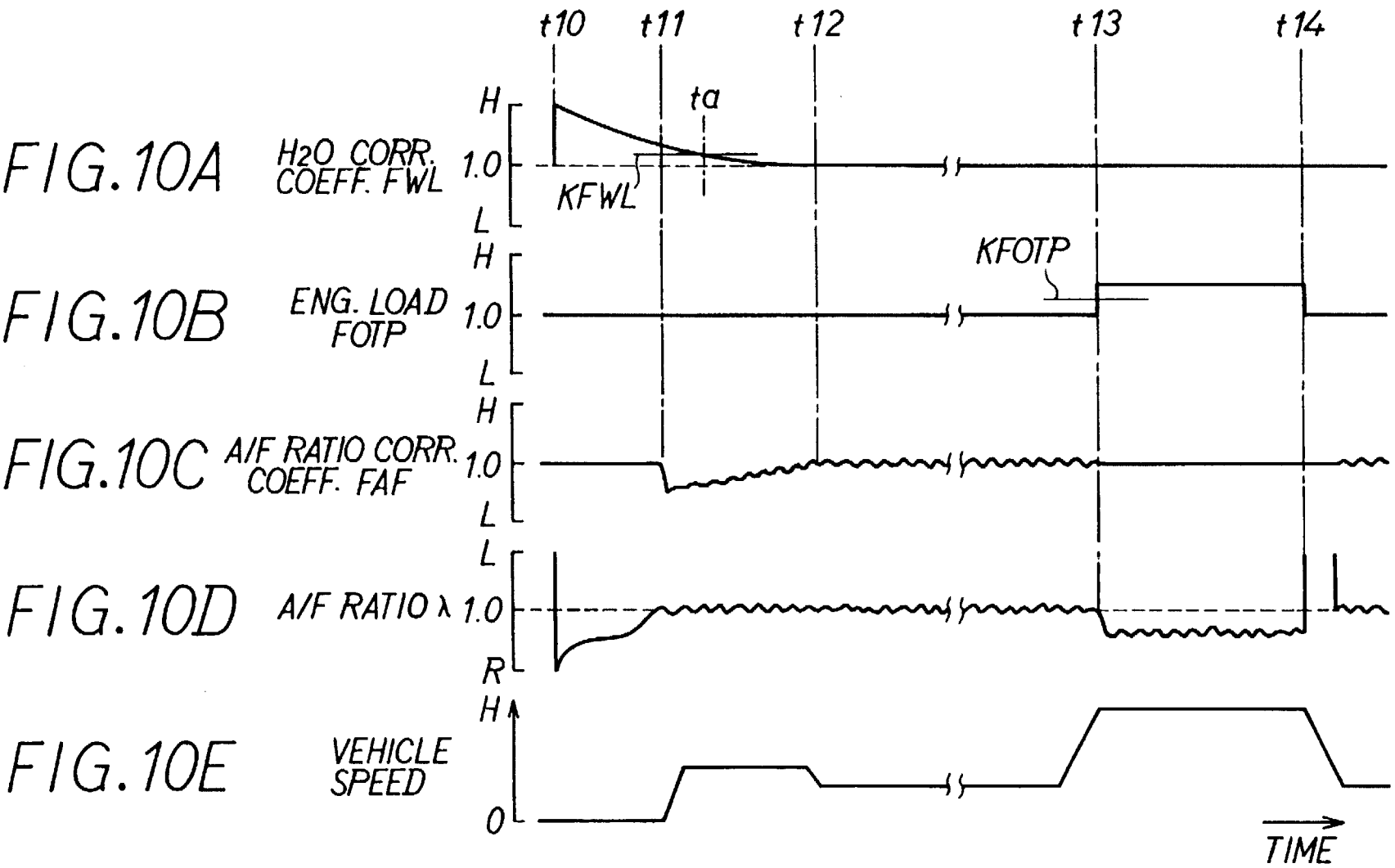
FIGS. 10A–10E are timing charts illustrating the diagnosis operation according to a second embodiment of the present invention.

FIG. 9 illustrates the outputs from the sensor 26 when the sensor 26 has abnormality. The characteristics of the sensor 26 when the sensor 26 is normal are indicated by curve La. The characteristics resulting from abnormality of the sensor 26, such as deterioration of devices or abnormality of the heater, are indicated by curves Lb and Lc. Assuming that the actual air-fuel ratio is 16, when the sensor 26 is normal, the limit current Ipa becomes the output from the sensor 26, and this output corresponds to the actual air-fuel ratio (A/F=16). On the other hand, when the sensor 26 is abnormal, the limit current Ipb, Ipc does not equal the limit current Ipa produced when the sensor 26 is normal, thus failing to detect the actual air-fuel ratio.

The sensor diagnosis routine executed by the CPU 42 synchronously with the fuel injection by the fuel injection valve 7 will be described with reference to FIGS. 8A and 8B.

Figure 8A:
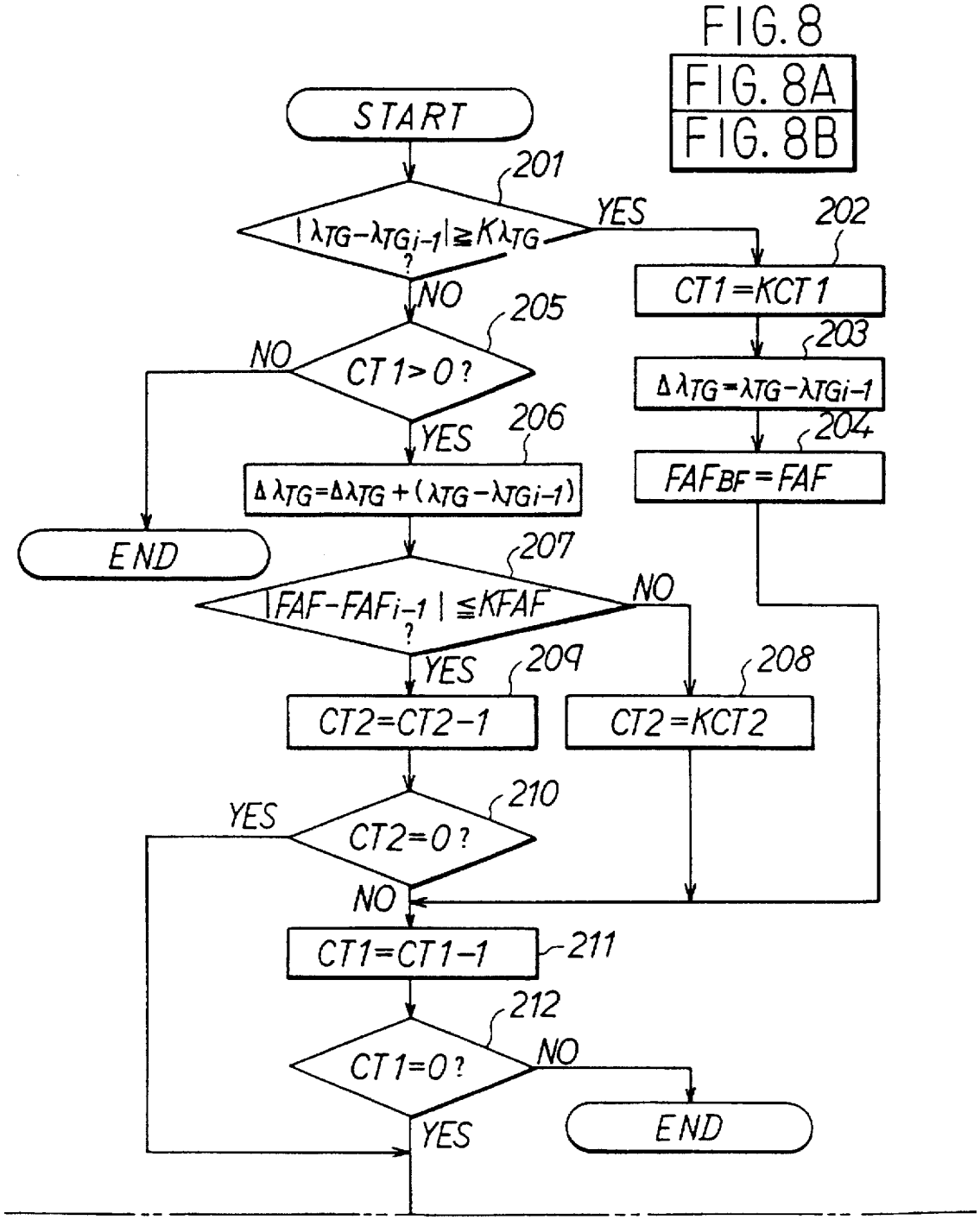

The CPU 42 determines in Step 201 of FIG. 8A whether the difference between the present target air-fuel ratio and the previous target air-fuel ratio λTi−1 is within a predetermined criterion λTG, that is, whether the present target air-fuel ratio λTG has sharply changed. If $|\lambda TG-\lambda Ti-1|<K\lambda TG$, then Step 201 makes a negative determination, and the operation proceeds to Step 205 to determine whether the value of the counter CT1 is greater than 0. If the target air-fuel ratio λTG is maintained at a predetermined value as in the case preceding the time t1 indicated in FIGS. 7A–7E, the CPU 42 holds counter CT1 at CT1=0 (initial value), and then ends the routine.

On the other hand, if $|\lambda TG-\lambda Ti-1|\geqq K\lambda TG$ so that Step 201 makes an affirmative determination (the time t1 in FIGS. 7A–7E), the CPU 42 proceeds to Step 202 to set the counter CT1 to a predetermined value KCT1 (KCT1 is, for example, a value corresponding to 15 injections). Then, the CPU 42 in Step 203 subtract the previous target air-fuel ratio λTi−1 from the present target air-fuel ratio λTG to determine a change ΔλTG of the present target air-fuel ratio λTG (ΔλTG=λTG−λTi−1). Then, Step 204 stores the current air-fuel ratio correction coefficient FAF as a before-change correction coefficient FAFBF.

Subsequently, the CPU 42 proceeds to Step 211 to decrement the counter CT1 by 1, and then to Step 212 to determine whether the value of the counter CT1 is 0. In earlier rounds of this routine, the CPU 42 makes a negative determination in Step 212, and immediately finishes the routine. The counter CT1 is decremented in Step 211 every round of the routine until Step 212 determines that CT1=0.

If Step 201 makes a negative determination after the sharp change of the target air-fuel ratio λTG (following the time t1 in FIGS. 7A–7E), the CPU 42 proceeds to Step 205. If CT1>0, then the CPU 42 proceeds to Step 206 to add the difference between the present target air-fuel ratio λTG and the previous target air-fuel ratio λTi−1 to the old "ΔλTG", thus updating "ΔλTG".

Then, the CPU 42 determines in Step 207 whether the difference between the present air-fuel ratio correction coefficient FAF and the previous air-fuel ratio correction coefficient FAFi−1 has become equal to or less than a predetermined value KFAF, that is, whether the air-fuel ratio correction coefficient FAF has converged to a predetermined value. If |FAF−FAFi−1>KFAF, that is, if the air-fuel ratio correction coefficient FAF has not converged yet (time t1 to t2 in FIGS. 7A–7E), the CPU 42 makes a negative determination in Step 207 and then proceeds to Step 208 to set the counter CT2 to a predetermined value KCT2 (KCT2 is, for example, a value corresponding to fifteen injections). On the other hand, if |FAF−FAFi−1|≦KFAF, that is, if the air-fuel ratio correction coefficient FAF has converged (after time t2 in FIGS. 7A–7E), the CPU 42 makes an affirmative determination in Step 207 and then proceeds to Step 209 to decrement the counter CT2 by 1. Subsequently, Step 210 determines whether the value of the counter CT2 is 0. If CT2≠0, then the CPU 42 proceeds to Step 211. The counter CT2 is decremented in Step 209 every round of the routine until Step 210 determines that CT2=0.

Figure 8B:
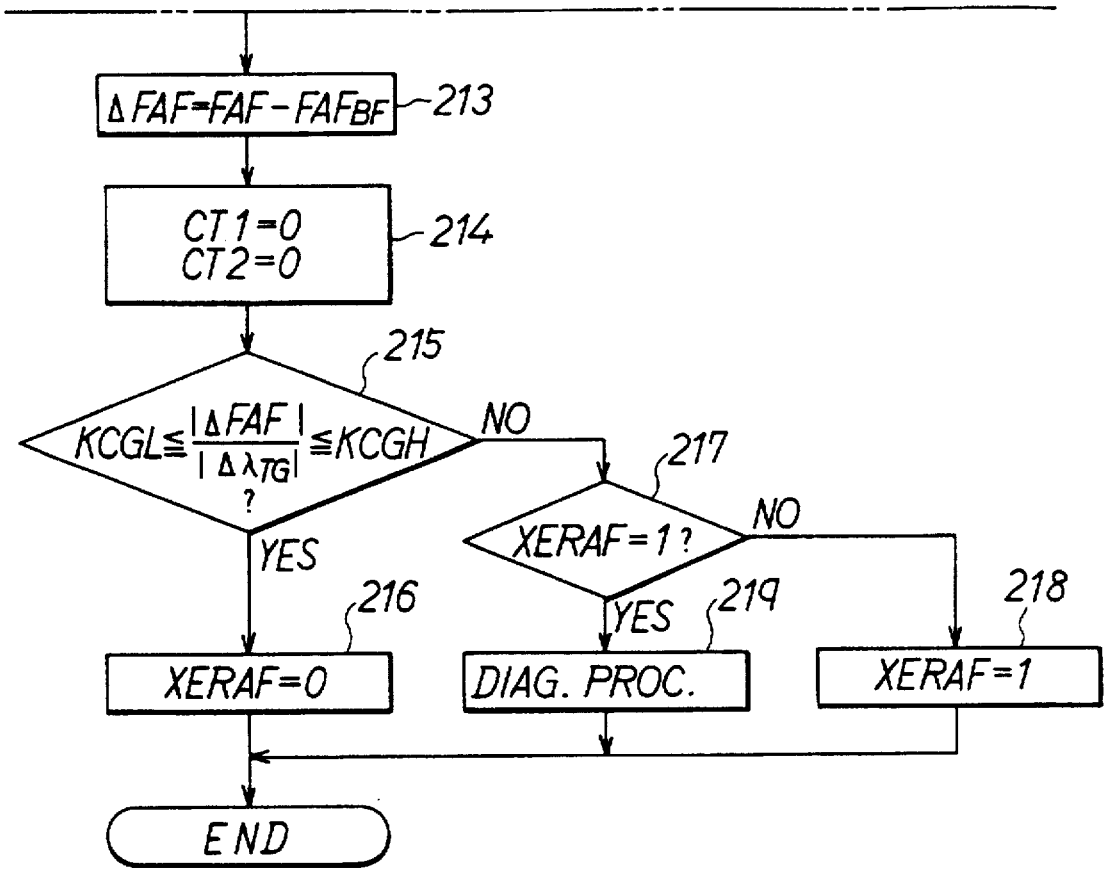

When the counter CT1 or CT2 reaches 0 (time t3 in FIGS. 7A–7E), the CPU 42 proceeds to Step 213 in FIG. 8B to subtract the before-change correction coefficient FAFBF stored in Step 204 from the present air-fuel ratio correction coefficient FAF to determine a change ΔFAF of the air-fuel ratio correction coefficient FAF (ΔFAF=FAF–FAFBF). Then, Step 214 resets the counters CT1 and CT2 to "0".

The CPU 42 determines in Step 215 whether the ratio between the absolute value of ΔFAF and the absolute value of ΔλTG is within a predetermined range KCGL–KCGH (for example, KCGL=0.9, KCGH=1.1). Step 215 makes an affirmative determination if the air-fuel ratio correction coefficient FAF has varied in accordance with changes of the target air-fuel ratio λTG. That is, if the air-fuel ratio sensor 26 outputs normal signals in accordance with changes of the target air-fuel ratio λTG, the output from the sensor 26 is involved in the change of the air-fuel ratio correction coefficient FAF. Thus, the CPU 42 determines that the air-fuel ratio sensor 26 is normal, and in Step 216 clears the abnormality determination flag XERAF to "0" before finishing the routine.

On the other hand, if the change of the air-fuel ratio correction coefficient FAF is excessively larger or smaller than the change of the target air-fuel ratio λTG, Step 215 makes a negative determination, that is, the CPU 42 determines that the output from air-fuel ratio sensor 26 is abnormal. The CPU 42 then proceeds to Step 217 to determines whether the abnormality determination flag XERAF has been set to "1". If XERAF=0, then the CPU 42 establishes XERAF=1 in Step 218. If an abnormality determination is made again in the next diagnosis operation, the CPU 219 performs a predetermined procedure for the diagnosis (for example, the turning on of the warning light 49, or the stopping of the air-fuel ratio feedback).

As described in detail above, this embodiment determines whether there is a need to output a correction instruction (Step 201 in FIG. 8A), and determines whether there is an abnormality in the air-fuel ratio sensor 26 on the basis of the comparison between the change ΔFAF of the air-fuel ratio correction coefficient FAF and the change ΔTG of the target air-fuel ratio λTG if the target air-fuel ratio λTG has sharply changed (Step 215 in FIG. 8B). This diagnosis operation can precisely and easily detect the occurrence of an abnormality in the air-fuel ratio sensor 26. As a result, the air-fuel ratio control system employing a linear air-fuel ratio sensor 26 as in this embodiment will not use an imprecise output from the sensor 26 for air-fuel ratio control, thus achieving highly precise and highly reliable air-fuel ratio control.

Second Embodiment

A second preferred embodiment will be described with the description thereof mainly focused on the features thereof that distinguish the second embodiment from the first embodiment. The second embodiment detects abnormality of the air-fuel ratio sensor 26 on the basis of the behavior of the signals outputted from the air-fuel ratio sensor 26 when the fuel injection amount is increased depending on the coolant temperature or high-load engine operation. According to this embodiment, the CPU 42 constitutes means for correcting injection amount and means for calculating total correction amount.

FIGS. 10A–10E are timing charts indicating the operation of the sensor diagnosis according to the second embodiment. This timing chart will be first described in detail. The internal combustion engine 1 is started at time point t10 with the switching-on operation using the ignition key. Since the coolant is at a low temperature during this period, a coolant temperature correction coefficient FWL is set to a value larger than 1.0 to perform a coolant temperature-dependent increase correction operation. The coolant temperature then gradually rises, and the air-fuel ratio feedback is started at time point t11 when the coolant temperature reaches 40° C. With the air-fuel ratio feedback, the air-fuel ratio correction coefficient FAF is set to a relatively small value (i.e., on the amount reduction side) for the current coolant temperature-dependent increasing correction. The air-fuel ratio correction coefficient FAF is increased as the coolant temperature-dependent correction coefficient FWL is reduced. At time point t12 when the engine 1 is sufficiently warmed up and the coolant temperature-dependent increasing correction is ended, the air-fuel ratio correction coefficient FAF converges to approximately to 1.0.

During the period from t10 to t11, the air-fuel ratio λ (detected by the air-fuel ratio sensor 26) is shifted to the rich side by the coolant temperature-dependent increasing correction. Thus, the diagnosis of the air-fuel ratio sensor 26 is performed on the basis of the behavior of the air-fuel ratio λ relative to the coolant temperature-dependent increasing correction. In the period t11–t12, the coolant temperature-dependent increasing correction is continued while the air-fuel ratio correction coefficient FAF is set to values that will reduce the fuel injection amount. The air-fuel ratio λ is thereby maintained approximately at the target air-fuel ratio λTG (λTG=1.0 in FIGS. 10A–10E) in this period. Therefore, the diagnosis of the air-fuel ratio sensor 26 is performed on the basis of the behavior of the air-fuel ratio λ relative to the coolant temperature-dependent increasing correction and the air-fuel ratio correction using the coefficient FAF in this period.

At time point t13 when the vehicle is traveling, high-load increasing correction is performed for acceleration. For this correction, the air-fuel ratio feedback is temporarily switched to open control, and the air-fuel ratio correction coefficient FAF is maintained substantially at 1.0. Further, a load-dependent correction coefficient FOTP is set to values that will increase the fuel injection amount, so that the air-fuel ratio (detected by the air-fuel ratio sensor 26) is shifted to the rich side. During a period t13–t14, the diagnosis of the air-fuel ratio sensor 26 is performed on the basis of the behavior of the air-fuel ratio λ relative to the high-load increasing correction.

Then, at time point t14 when the vehicle starts to slow down, the high-load increasing correction is ended, and the load-dependent correction coefficient is set back to 1.0. At this timing, a fuel cut is performed so that the air-fuel ratio λ is temporarily shifted further to the lean side. Following the fuel cut, the air-fuel ratio feedback is restarted.

Figure 11:
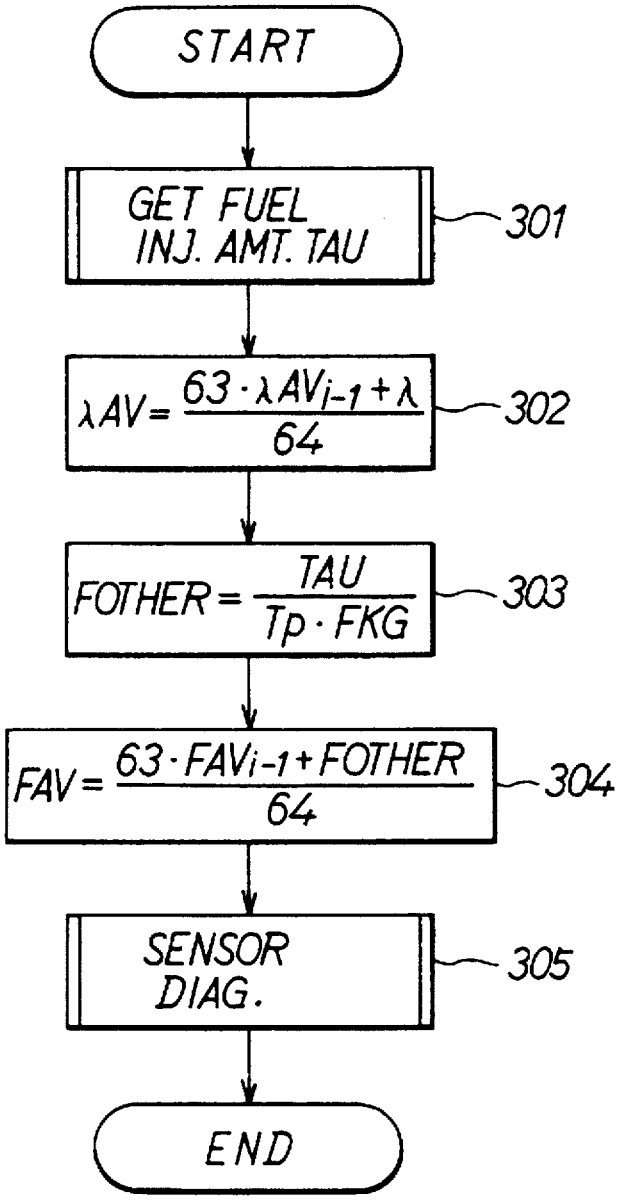
FIG. 11 is a flowchart illustrating a fuel injection main routine.
Figure 12:
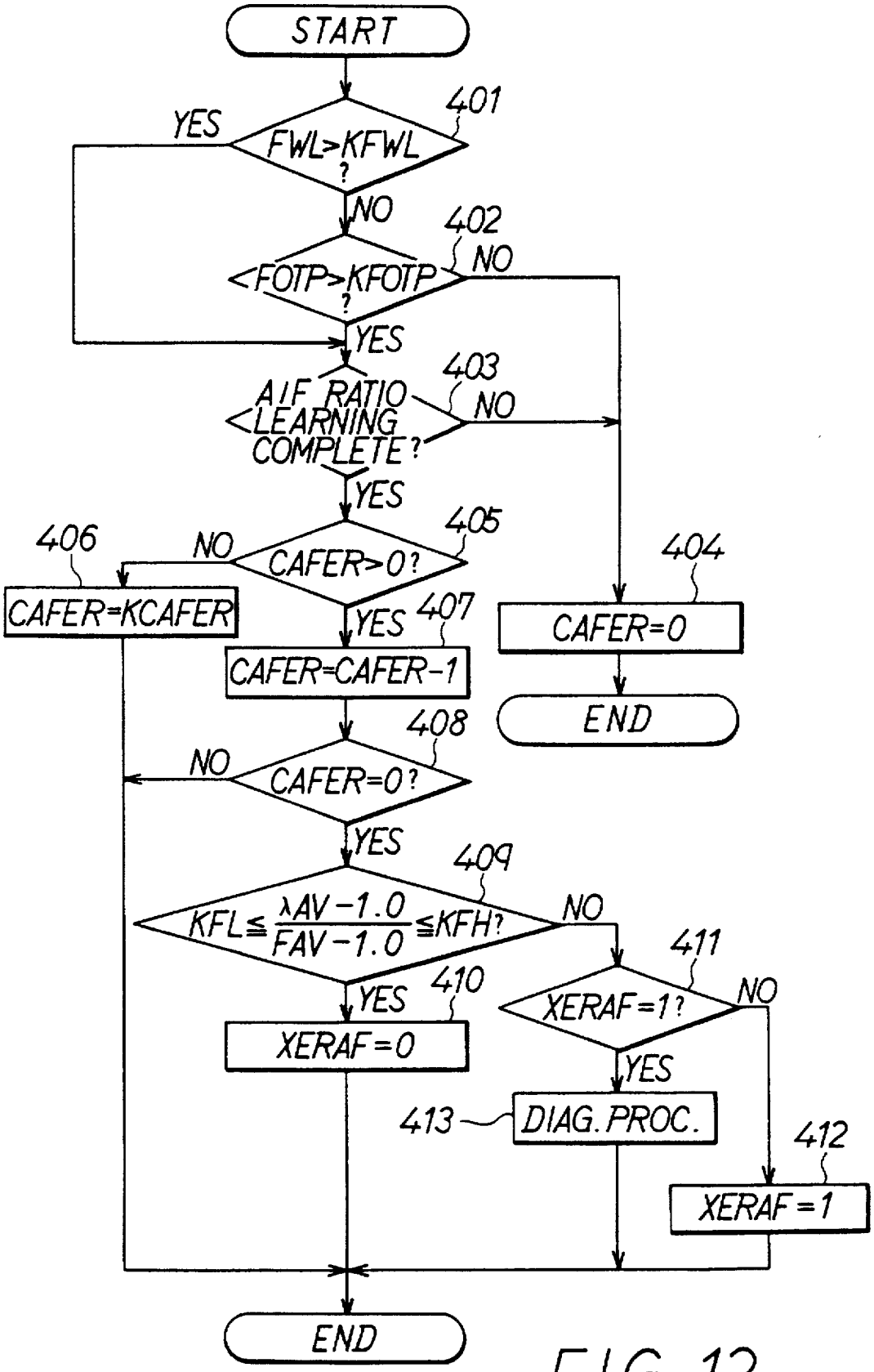
FIG. 12 is a flowchart illustrating a sensor diagnosis routine according to the second embodiment.

The computation performed by the CPU 42 to achieve the above-described operation will be described with reference to the flowcharts shown in FIGS. 11 and 12. The flowchart of FIG. 11 illustrates the fuel injection main routine executed synchronously with injection. The flowchart of FIG. 12 illustrates the sensor diagnosis routine.

Referring to FIG. 11, the CPU 42 executes in Step 301 the routine illustrated in FIG. 5 to calculate a fuel injection amount TAU. Then, Step 302 calculates an air-fuel ratio average λAV by the average calculation {λAV=(63–λAVi–1+λ)/64}.

In Step 303, the CPU 42 divides the fuel injection amount TAU by the product of the basic fuel injection amount and the air-fuel ratio learned value FKG to determine a fuel correction amount FOTHER relative to the fuel injection amount TAU (the correction amount excluding the air-fuel ratio learned value) {FOTHER=TAU/(Tp–FKG)}. The fuel correction coefficient FOTHER corresponds to the total correction amount including, for example, the coolant temperature-dependent correction coefficient FWL, the load-dependent correction coefficient FOTP and the air-fuel ratio correction coefficient FAF. Essentially, the basic fuel injection amount Tp calculated on the basis of the engine operating conditions (e.g., the engine speed Ne, the intake air pressure PM) should be determined to drive the air-fuel ratio λ to the theoretical air-fuel ratio λ=1. The variations of the fuel injection amount caused by differences of individual engines or changes over time are corrected by the air-fuel ratio learned value FKG. Thus, the division of "TAU" by "Tp×FKG" provides the total correction amount for achieving the air-fuel ratio λ=1.

In Step 304, the CPU calculates a correction coefficient average FAV {FAV=(63−FAVi−1+FOTHER)/64}. Subsequently, Step 305 executes the sensor diagnosis routine illustrated in FIG. 12.

The sensor diagnosis routine illustrated in FIG. 12 will now be described. The CPU 42 determines in Step 401 whether the coolant temperature-dependent correction coefficient FWL is greater than a predetermined criterion KFW. For example, while the coolant temperature-dependent increasing correction is performed following the start of the engine 1, FWL>KFWL is established and Step 401 makes an affirmative determination. Then, Step 402 determines whether the load-dependent correction coefficient FOTP is greater than a predetermined criterion KFOTP. For example, during the high-load increasing correction (at the time t13 in FIGS. 10A–10E), FOTP>KFOTP is established and Step 402 makes an affirmative determination.

The CPU 42 determines in Step 403 whether the air-fuel ratio learning operation has been completed for the entire operational region of the internal combustion engine 1. If the air-fuel ratio learning operation has not been completed (NO in Step 403), or if there is no need for the coolant temperature-dependent increasing correction or the high-load increasing correction (NO in both Step 401 and Step 402), the CPU 42 proceeds to Step 404 to clear a counter CAFER to "0", and then ends the routine. That is, variations of the fuel injection amount caused by differences of individual engines or changes over time cannot be corrected for regions for which the air-fuel ratio learning operation has not been performed. Therefore, the diagnosis is executed according to this embodiment only after the air-fuel ratio learning operation has been completed.

On the other hand, if either the coolant temperature-dependent increasing correction or the high-load increasing correction is being performed and the air-fuel ratio learning operation has been completed (YES in either Step 401 or Step 402, and YES in Step 403), the CPU 42 proceeds to Step 405 to determine whether the value of the counter CAFER is greater than 0. For a starting round of the diagnosis operation where CAFER=0 (initial value), Step 405 makes a negative determination, and proceeds to Step 406 to set the counter CAFER to a predetermined value KCAFER (for example, a value corresponding to fifteen injections).

Once the counter CAFER is set in Step 406, Step 405 makes an affirmative determination in later rounds of operation, and Step 407 decrements the counter CAFER by 1. The CPU 42 determines in Step 408 whether the counter CAFER has reached 0. If CAFER=0 is reached, the CPU 42 makes an affirmative determination in Step 408, and the operation proceeds to Step 409. In Step 409, the CPU 42 calculates a deviation of the air-fuel ratio average λAV determined in Step 302 from the target air-fuel ratio λTG (λTG=1.0 according to this embodiment), that is, λAV−1.0, and a deviation of the correction coefficient average FAV from a reference value (=1.0), that is, FAV−1.0. Step 409 then determines the ratio of these deviations (λAV−1.0)/(FAV−1.0). Further, Step 409 determines whether the ratio is within a predetermined range KFL–KFH (for example, KFL=−0.8, KFH=−1.2).

If Step 409 makes an affirmative determination, the CPU 42 clears the diagnosis determination flag XERAF to "0" in Step 410 followed by the end of this routine. On the other hand, if Step 409 makes a negative determination, the CPU 42 determines that abnormality has occurred, and proceeds to Step 411 to determine whether the diagnosis determination flag XERAF has been set to "1". If XERAF=0, then the CPU 42 establishes XERAF=1 in Step 412. If an abnormality determination is made again in the next round of this routine, Step 413 performs procedures for the diagnosis (for example, the turning on of the warning light 49 and/or the stopping of the air-fuel ratio feedback).

As described above, the second embodiment determines a total correction amount with respect to the basic fuel injection amount Tp calculated on the basis of the engine speed Ne and the engine load (intake air pressure PM) (Steps 303, 304 in FIG. 11), and determines whether there is abnormality in the air-fuel ratio sensor 26 on the basis of the comparison between the total correction amount and the change of the air-fuel ratio λ detected by the air-fuel ratio sensor 26 (Step 409 in FIG. 12). Therefore, the second embodiment precisely and easily detects occurrence of abnormality as in the first embodiment.

Third Embodiment

A third embodiment will now be described. The third embodiment determines whether abnormality has occurred in the air-fuel ratio sensor 26 on the basis of the behavior of the air-fuel ratio λ (detected by the air-fuel ratio sensor 26) during transitional engine operation. According to this embodiment, the CPU 42 constitutes amplitude detecting means.

FIGS. 13A–13C are timing charts indicating the operation of the sensor diagnosis according to the third embodiment. At time point t21 when the vehicle is rapidly accelerated, the air-fuel ratio λ is temporarily varied to the lean side and to the rich side. At time point t22 when the vehicle is suddenly decelerated, the air-fuel ratio λ also fluctuates to a large extent. In such a period, the sensor diagnosis is performed on the basis of the difference between the lean peak ratio λL and the rich peak ratio λR achieved by fluctuation of the air-fuel ratio λ (that is, the amplitude of the air-fuel ratio λ).

Figure 14:
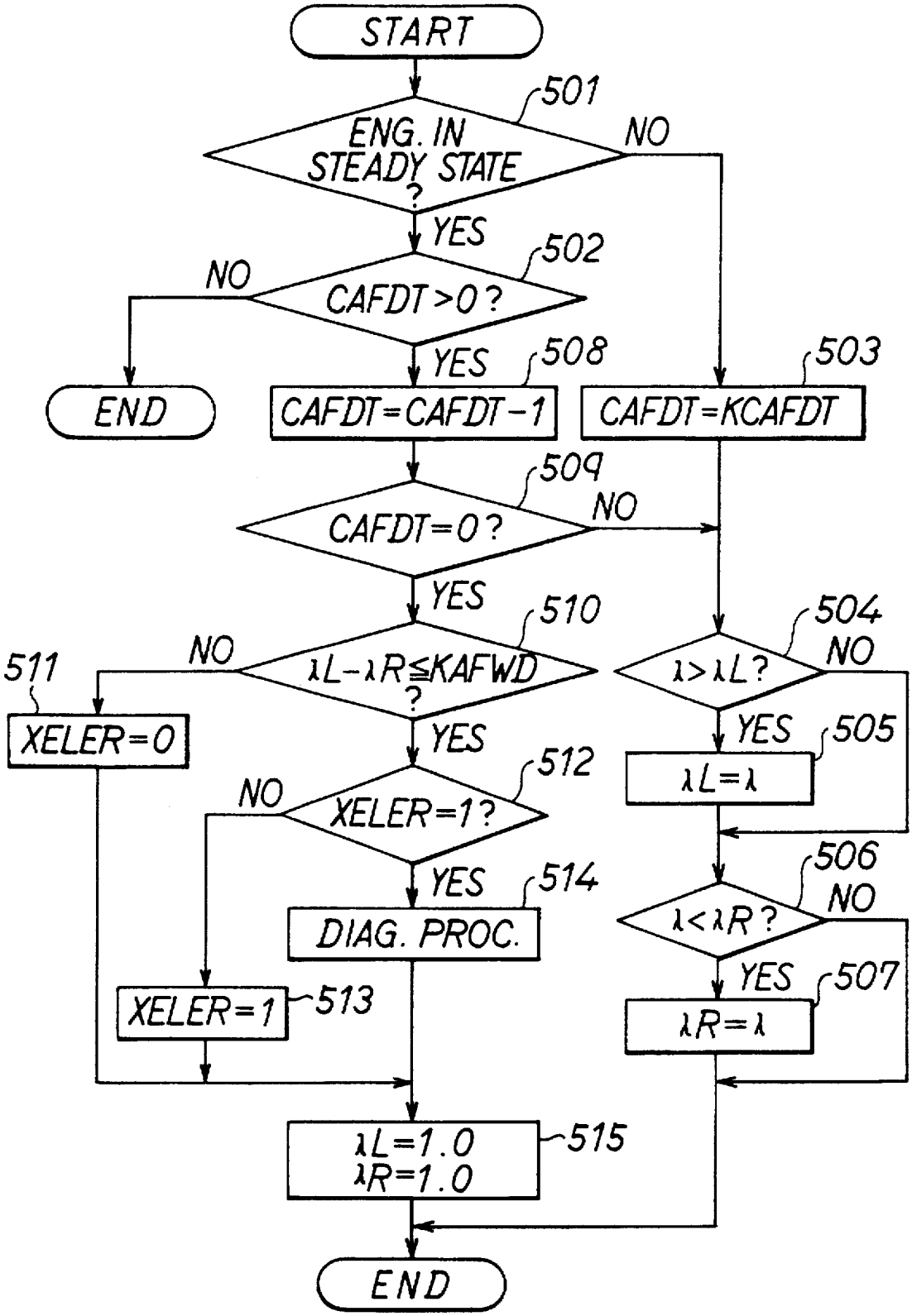
FIG. 14 is a flowchart illustrating a sensor diagnosis routine according to the third embodiment.

FIG. 14 illustrates the sensor diagnosis routine according to the third embodiment. The CPU 42 determines in Step 501 whether the internal combustion engine 1 is in a steady operating condition state. The determination regarding the steady conditions is made on the basis of whether the engine is accelerated or decelerated, whether the target air-fuel ratio λTG is sharply changed, or whether the air-fuel ratio correction coefficient FAF is sharply changed. If it is determined that the engine 1 is in the steady operating condition, the CPU 42 proceeds to Step 502 to determine whether the value of a counter CAFDT is greater than 0. For a starting round of this routine when the counter CAFDT has not been set (initial value CAFDT=0), the CPU 42 makes a negative determination in Step 502 and immediately ends the routine.

If the engine 1 is rapidly accelerated, that is, in the transitional operating conditions, the CPU 42 makes a negative determination (time t21 in FIGS. 13A–13C) in Step 502, and sets the counter CAFDT to a predetermined value KCAFDT in Step 503. The CPU 42 then proceeds to Step 504 to determine whether the present air-fuel ratio is greater than the lean peak ratio λL stored (that is, whether the present air-fuel ratio is further into the lean side than the lean peak ratio λL). If λ>λL, Step 505 updates the lean peak ratio λL. In Step 506, the CPU 42 determines whether the present air-fuel ratio is smaller than the rich peak ratio λR stored (that is, whether the present air-fuel ratio is further into the rich side than the rich peak ratio λR). If λ<λR, Step 507 updates the rich peak ratio λR. The lean and rich peak ratios λL, λR during transitional periods are thus updated.

If the engine 1 resumes the steady operating condition, the CPU 42 proceeds from Step 501 to Step 502 and then to 508. Step 508 decrements the counter CAFDT by 1. The CPU 42 determines in Step 509 whether the counter CAFDT is 0. If CAFDT≠0, the CPU 42 proceeds to Step 504 described above. Thus, during a period (t21–t22 in FIGS. 13A–13C) when the counter CAFDT is decremented, the lean and rich peak ratios λL and λR are updated in Steps 504–507.

If CAFDT=0 is established (time t23 in FIGS. 13A–13C), the CPU 42 makes an affirmative determination in Step 509. In Step 510, the CPU 42 determines whether the difference between the lean peak ratio λL and the rich peak ratio λR is equal to or less than a predetermined criterion KAFWD. If λL−λR>KAFWD, that is, if Step 510 makes a negative determination, the CPU 42 proceeds to Step 511 to clear a diagnosis determination flag XELER to "0". That is, the CPU 42 determines that the fuel increasing correction caused by sharp acceleration or deceleration or the like is normally reflected in the output from the air-fuel ratio sensor 26 and thus determines that sensor 26 is normal. Then, the CPU 42 proceeds to Step 515 to reset the lean and rich peak ratios λL and λR to 1.0 for the next diagnosis operation and then ends this routine.

On the other hand, if λL−λR≦KAFWD, that is, if Step 510 makes an affirmative determination, the CPU 42 proceeds to Step 512 to determine whether the abnormality determination flag XELER has been set to "1". If the abnormality determination flag XELER has not been set to "1", the CPU 42 establishes XELER=1 in Step 513. If an occurrence of abnormality is again determined in the next operation of the diagnosis (Steps 501–510), the CPU 42 performs the procedure for the diagnosis.

As described above, the third embodiment determines the amplitude of the air-fuel ratio λ detected by the air-fuel ratio sensor 26 when the engine 1 is in the transitional operating condition, and determines whether there is abnormality in the air-fuel ratio sensor 26 (Step 510 in FIG. 14). Thus, the third embodiment precisely and easily performs the sensor diagnosis as in the first and second embodiments.

Figure 15A:
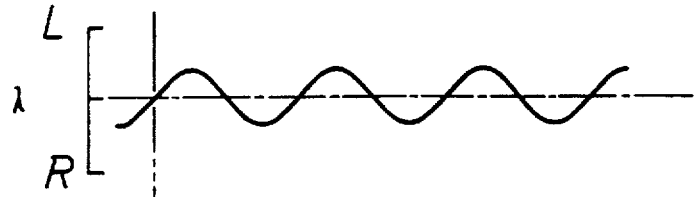
FIGS. 15A–15G are timing charts indicating various forms of abnormality.

As described above, the third embodiment determines an air-fuel ratio correction coefficient FAF in accordance with the difference between the air-fuel ratio λ and the target air-fuel ratio λTG (λTG=1.0 according to the first embodiment). If abnormality occurs in the air-fuel ratio sensor 26, the behavior of the air-fuel ratio correction coefficient FAF relative to the air-fuel ratio λ (output from the sensor 26) becomes unstable. FIGS. 15A–15G are timing charts indicating various forms of abnormalities determined on the basis of a comparison between the output from the sensor 26 and the air-fuel ratio correction coefficient FAF. FIG. 15A indicates the waveform of a normal output from the sensor 26 (air-fuel ratio λ). FIGS. 15B–15G indicate waveforms of the outputs from the sensor 26 or the air-fuel ratio correction coefficient FAF occurring when the sensor 26 is abnormal.

Figure 15B:
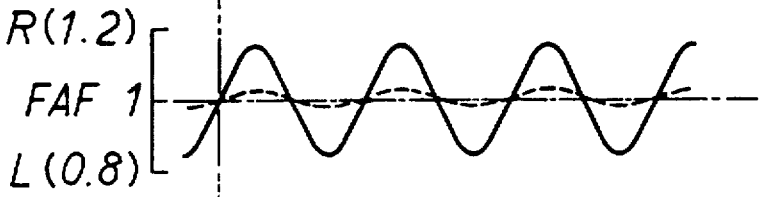

The abnormality of the air-fuel ratio sensor 26 in various forms will be described with reference to FIGS. 15A–15G. Compared with the amplitude of the air-fuel ratio λ indicated in FIG. 15A, the amplitude of the air-fuel ratio correction coefficient FAF indicated in FIG. 15B is larger (indicated by the solid line) or smaller (indicated by the broken line). For example, if the air-fuel ratio sensor 26 deteriorates, the air-fuel ratio sensor 26 becomes unable to output signals (limit currents) that correspond to the actual air-fuel ratio λ. In such a case, the air-fuel ratio correction coefficient FAF in accordance with the difference between the actual air-fuel ratio λ and the target air-fuel ratio λTG cannot be obtained, thus causing excessively large or small fluctuation of the air-fuel ratio correction coefficient FAF.

More specifically, when the sensor body 32 of the air-fuel ratio sensor 26 deteriorates, the device internal resistance increases. In such a case, the slope of the voltage-current characteristic curve (as shown in FIG. 16) within a resistance-dominant region (that is, a voltage region where the voltage is smaller than the voltages corresponding to the segment of the curve parallel to the voltage axis) becomes less when abnormality (deterioration) has occurred (indicated by dotted line) than when the sensor body 32 is normal (indicated by solid line) (Ip2<Ip1). That is, the deterioration reduces the limit current that flows through the air-fuel ratio sensor 26. In addition, the straight segment of the characteristic curve (as shown in FIG. 16) parallel to the voltage axis becomes inclined (the curve indicated by the dot-dash line is inclined upwards to the right), and therefore the limit current increases over the normal level (Ip3>Ip1). In these cases, precise detection of the air-fuel ratio λ becomes impossible so that the difference between the actual air-fuel ratio λ and the target air-fuel ratio λTG becomes excessively large or small, resulting in large deviations of the amplitude of the air-fuel ratio correction coefficient FAF from that of the actual air-fuel ratio λ.

Figure 15C:
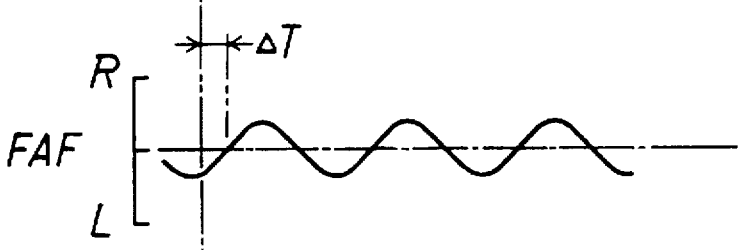

In FIG. 15C, the phase of the air-fuel ratio correction coefficient FAF is delayed a predetermined amount ΔT from that of the air-fuel ratio λ detected by the air-fuel ratio sensor 26 (indicated in FIG. 15A). More specifically, if the response delay of the air-fuel ratio sensor 26 is caused by contamination of the sensor 26 (for example, clogging of the pores 31*a* of the cover 31, or clogging of the porous materials in the electrode layers 36, 37 shown in FIG. 2), the phase of the air-fuel ratio correction coefficient FAF deviates as indicated in FIG. 15C.

Figure 15D:
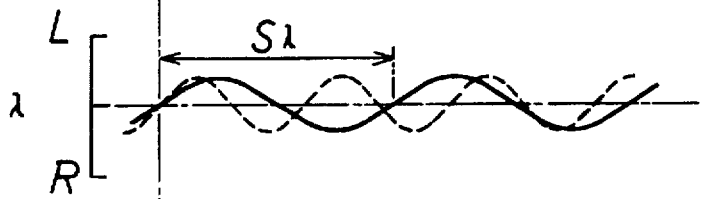
Figure 15E:
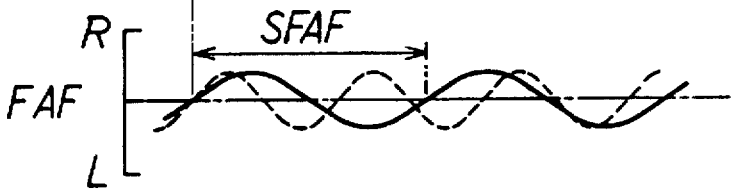

In FIGS. 15D and 15E, the period Sλ of the air-fuel ratio detected by the air-fuel ratio sensor 26 is increased, and the period SFAF of the air-fuel ratio correction coefficient FAF is also increased. That is, at least one of the period Sλ of the air-fuel ratio detected by the air-fuel ratio sensor 26 and the period SFAF of the air-fuel ratio correction coefficient FAF will become abnormal if a plurality of abnormality factors, such as deviation of the air-fuel ratio correction coefficient FAF in amplitude and phase, occur. Further, if the output gain of the air-fuel ratio sensor 26 decreases or the response thereof is delayed, the periods Sλ, SFAF exceeds allowed values. If the output gain of the air-fuel ratio sensor 26 increases or the response thereof becomes quick, the periods Sλ, SFAF becomes lower than allowed values.

Figure 15F:
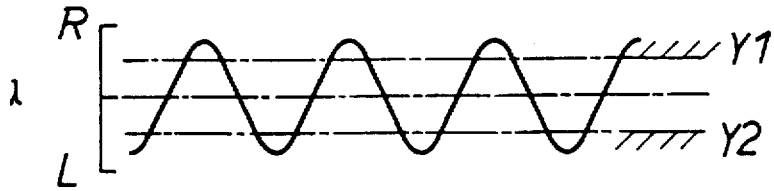
Figure 15G:
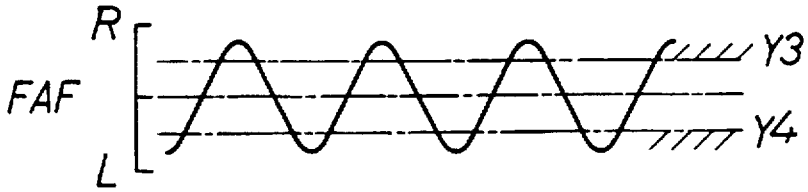

In FIGS. 15F and 15G, the amplitude of the air-fuel ratio λ detected by the air-fuel ratio sensor 26 or the amplitude of the air-fuel ratio correction coefficient FAF is greater than a predetermined allowed range. The abnormalities indicated in FIGS. 15F and 15G are likely to occur when a plurality of abnormality factors, such as deviation of the air-fuel ratio correction coefficient FAF in amplitude and phase, occur.

Fourth Embodiment

Figures 17, 17A, 17B:
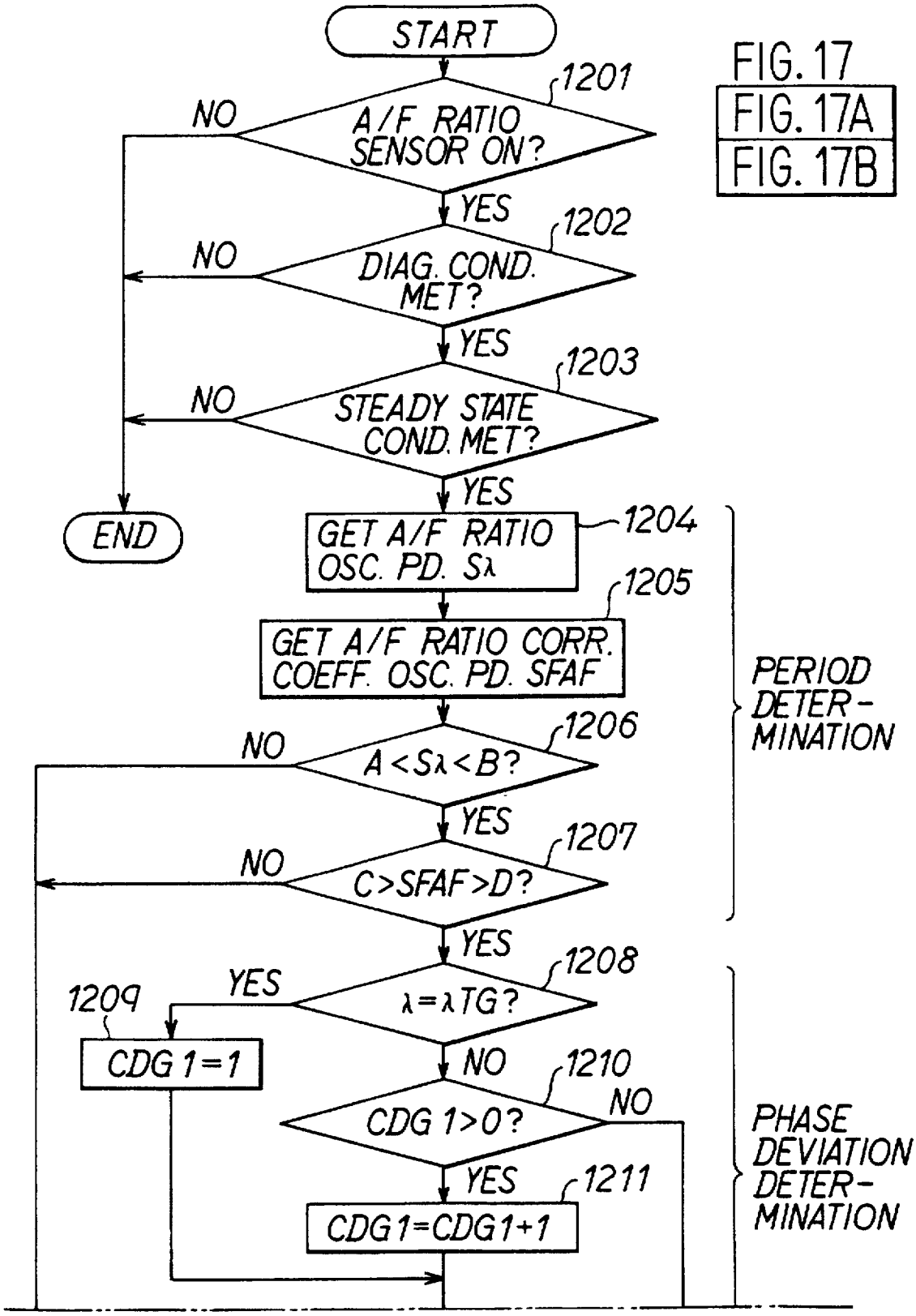
FIGS. 17, 17A and 17B are flowcharts illustrating a first sensor diagnosis routine.
Figure 17B:
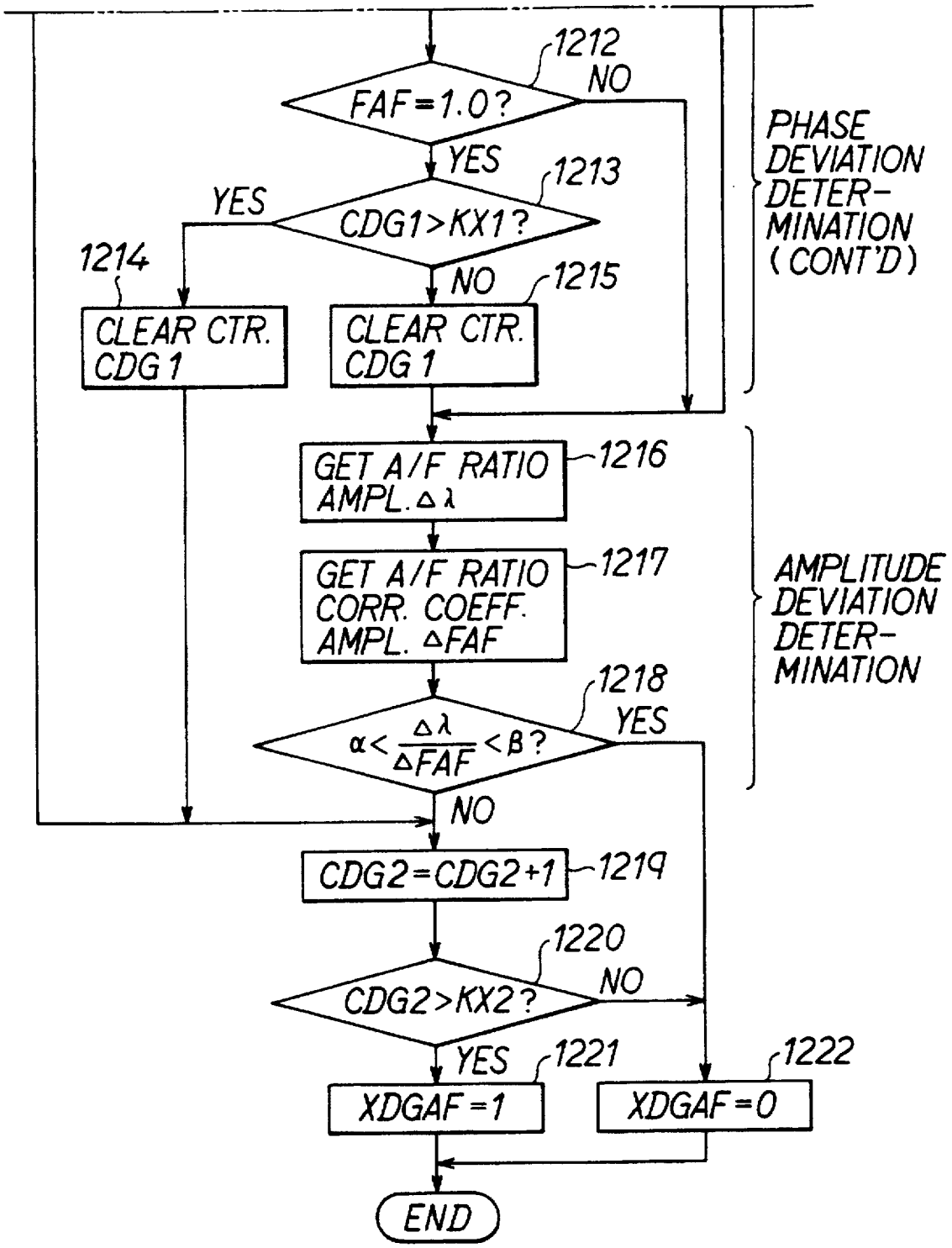

According to a fourth embodiment of the present invention, the following diagnosis operation is executed to determine various forms of abnormalities described above. FIGS. 17A and 17B illustrate a first diagnosis routine executed by the CPU 42 synchronously with fuel injection.

In Step 1201 in FIG. 17A, the CPU 42 determines whether the air-fuel ratio sensor 26 is activated. More specifically, the CPU 42 determines that the air-fuel ratio sensor 26 is activated if the device temperature of the air-fuel ratio sensor 26 (the temperature of the sensor body 32) equals or exceeds 650° C. or if the device resistance of the air-fuel ratio sensor 26 is equal to or lower than 90Ω. The CPU 42 then determines in Step 1202 whether predetermined diagnosis conditions have been established. In Step 1203, the CPU 42 determines whether predetermined steady operating conditions of the engine 1 have been established. The establishment of the diagnosis conditions concerned in Step 1202 comprises the air-fuel ratio feedback conditions having been established, and a predetermined length of time having elapsed following the start of the air-fuel ratio feedback. The establishment of the steady operating conditions in Step 1203 comprises the intake air pressure PM being equal to or lower than a predetermined level, the engine speed Ne being equal to or lower than a predetermined value, the throttle opening TH being equal to or lower than a predetermined value, or the engine being in an idle state.

If Steps 1201–1203 all make affirmative determinations, the CPU 42 executes the diagnosis based on a determination regarding the oscillation period. If no abnormality is detected on the basis of the oscillation period, the CPU 42 proceeds to Steps 1208–1215 to execute the diagnosis based on determinations regarding the phase deviation. If no abnormally is detected on the basis of the oscillation period nor the phase deviation, the CPU 42 executes in Steps 1216–1218 the diagnosis based on the amplitude deviation. These diagnosis procedures will be described in detail below.

In the period determination (Steps 1204–1207), the CPU 42 reads in the oscillation period Sλ of the air-fuel ratio λ in Step 1204, and the oscillation period SFAF of the air-fuel ratio correction coefficient FAF in Step 1205. The periods Sλ and SFAF are calculated by a calculation routine described later.

The CPU 42 then determines in Step 1206 whether the period Sλ of the air-fuel ratio λ is within a predetermined allowed range (A–B). Step 1207 determines whether the period Sλ of the air-fuel ratio correction coefficient FAF is within a predetermined allowed range (C–D). If the periods Sλ and SFAF are within the predetermined allowed ranges, Steps 1206 and 1207 make affirmative determinations, that is, it is determined that no abnormality regarding the period has occurred. The CPU 42 then proceeds to Step 1208 (that is, to the phase deviation determination). On the other hand, if either Step 1206 or Step 1207 makes negative determination, the CPU 42 determines that abnormality has occurred regarding the period, and proceeds to Step 1219 in FIG. 17B.

In the phase deviation determination (Steps 1208–1215), the CPU 42 determines whether the air-fuel ratio λ corresponds to the target air-fuel ratio λTG in Step 1208. If λ=λTG, then the CPU 42 proceeds to Step 1209 to set a phase deviation counter CDG1 to "1". If λ≠λTG, then the CPU 42 proceeds to Step 1210 to determine whether the value of the phase deviation counter CDG1 is greater than 0. In the case where Step 1209 has not been executed, CDG1=0, and therefore the CPU 42 makes a negative determination in Step 1210 and proceeds to Step 1216 (described later). In the case where Step 1209 has been executed, CDG1>0 and therefore the CPU 42 makes an affirmative determination in Step 1210 and proceeds to Step 1211 to increment the phase deviation counter CDG1 by 1.

Subsequently, the CPU 42 determines in Step 1212 in FIG. 17B whether the air-fuel ratio correction coefficient FAF is 1. If FAF≠1, then the CPU 42 immediately proceeds to Step 1216. If FAF=1, then the CPU 42 proceeds to 1213 to determine whether the phase deviation counter CDG1 exceeds a predetermined criterion KX1. In the case where the deviation in phase between the air-fuel ratio λ and the air-fuel ratio correction coefficient FAF is within a predetermined allowed range, that is, CDG1≦KX1, Step 1213 makes a negative determination, that is, it is determined that no abnormal deviation in phase has occurred. The CPU 42 then clears the phase deviation counter to "0" in Step 1215 and proceeds to Step 1216 (that is, to the amplitude deviation determination). The phase deviation counter CDG1 performs counting as indicated in FIGS. 18A–18E.

On the other hand, if the deviation in phase between the air-fuel ratio λ and the air-fuel ratio correction coefficient FAF exceeds the predetermined allowed range (CDG>KX1), Step 1213 makes an affirmative determination, that is, it is determined that an abnormal phase deviation has occurred. The CPU 42 then clears the phase deviation counter CDG1 to "0" in Step 1214 and proceeds to Step 1219.

Figures 18A, 18B, 18C, 18D, 18E:
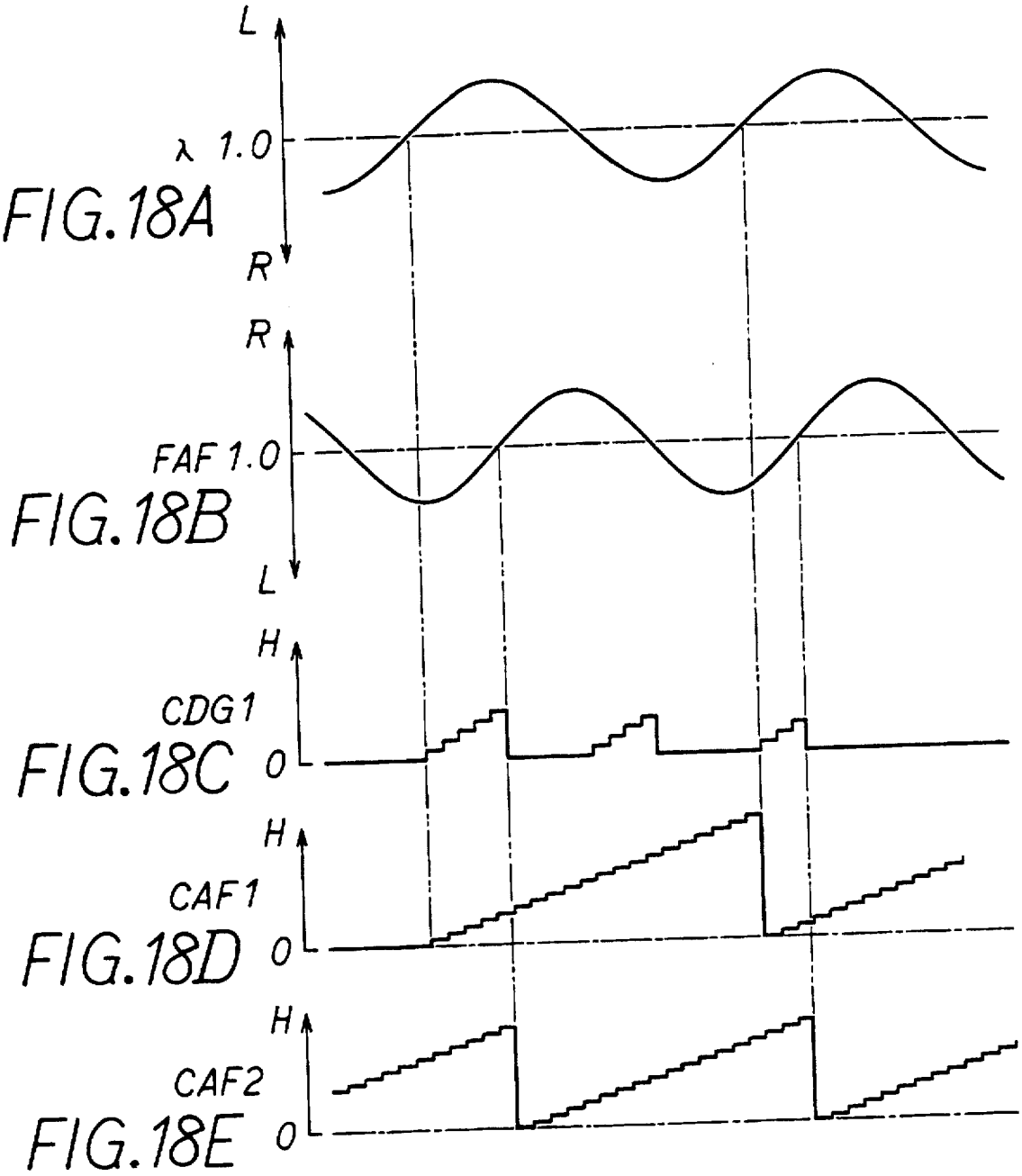
FIGS. 18A–18E are timing charts indicating the operations of various counters.

In the amplitude deviation determination (Steps 1216–1218), the CPU 42 reads in the amplitude Δλ of the air-fuel ratio λ in Step 1216, and the amplitude ΔFAF of the air-fuel ratio correction coefficient FAF in Step 1217. The amplitudes Δλ and ΔFAF take values as indicated in FIGS. 18A and 18B and are calculated by the calculation routine described later.

Subsequently, the CPU 42 determines in Step 1218 whether the ratio between the amplitude Δλ and the amplitude ΔFAF is within a predetermined allowed range, that is, whether $\alpha<(\Delta\lambda/\Delta FAF)<\beta$ (for example, α=0.8, β=1.2). If the ratio between the amplitude Δλ and the amplitude ΔFAF is within the predetermined allowed region, Step 1218 makes an affirmative determination, that is, it is determined that no abnormal amplitude deviation has occurred. The CPU 42 then proceeds to Step 1222. If Step 1218 makes a negative determination, that is, it is determined that an abnormal amplitude deviation has occurred, then the CPU 42 proceeds to Step 1219.

The affirmative determination in Step 1218 means that no abnormality has occurred in the period, the phase deviation nor the amplitude deviation. Thus, the CPU 42 clears an abnormality determination flag XDGAF to "0" in Step 1222 and then ends this routine.

If an abnormality is detected in any of the period, the phase deviation and the amplitude deviation, the CPU 42 increments an abnormality determination counter CDG2 by 1 in Step 1219 and then determines in Step 1220 whether the abnormality determination counter CDG2 exceeds a predetermined criterion KX2. If CDG2≦KX2, the CPU 42 proceeds to Step 1222 to clear the abnormality determination flag XDGAF to "0". If CDG2>KX2, the CPU 42 proceeds to Step 1221 to set the abnormality determination flag XDGAF to "1". Together with the setting operation for the abnormality determination flag XDGAF, the CPU 42 performs procedures for diagnosis, such as the turning on of the warning light 49 or the stopping of the air-fuel ratio feedback. As described above, the first diagnosis routine as illustrated in FIGS. 17A and 17B easily detects various forms of abnormalities as indicated in FIGS. 15B–15E.

The procedure of calculating the period Sλ of the air-fuel ratio λ and the period of SFAF of the air-fuel ratio correction coefficient FAF read by the CPU 42 in Steps 1204 and 1205 will be described with reference to the flowcharts shown in FIGS. 19 and 20.

Figure 19:
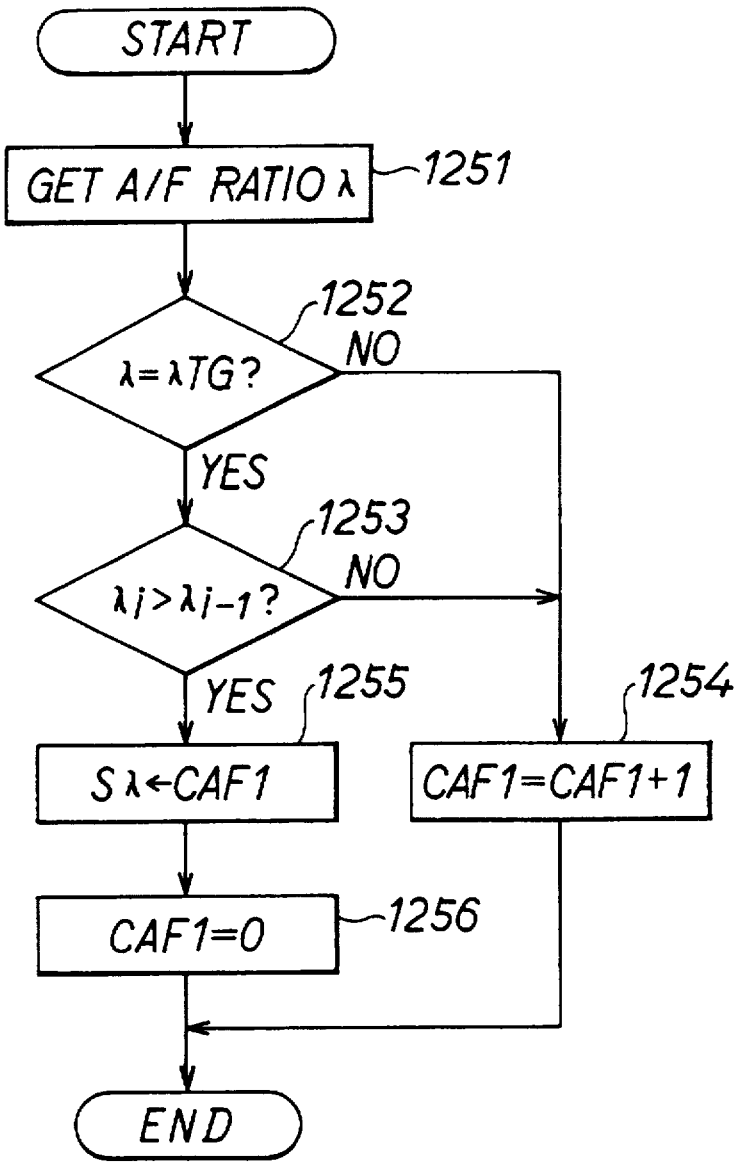
FIG. 19 is a flowchart illustrating a routine for calculating the oscillation period of air-fuel ratio.

In Step 1251 in FIG. 19, the CPU 42 reads in the air-fuel ratio λ calculated on the basis of the detection by the air-fuel ratio sensor 26. The CPU then determines in Step 1252 whether the air-fuel ratio λ corresponds to the target air-fuel ratio λTG (λTG=1.0). Further, Step 1253 determines whether the present air-fuel ratio λi exceeds the previous air-fuel ratio λi−1, that is, whether λi>λi−1. If either Step 1252 or Step 1253 makes a negative determination, the CPU 42 proceeds to Step 1254 to increment a period counter CAF1 by 1.

If both Step 1252 and Step 1253 make an affirmative determination, the CPU 42 proceeds to Step 1255 to store the value of the period counter CAF1 as the period Sλ of the air-fuel ratio λ. Then, the CPU 42 clears the period counter CAF1 to "0" in Step 1256 and ends the routine. The period counter CAF1 operates as indicated in FIGS. 18D.

The period SFAF of the air-fuel ratio correction coefficient FAF is calculated by a procedure similar to that of FIG. 19. This procedure will be described with reference to FIG. 20.

Figure 20:
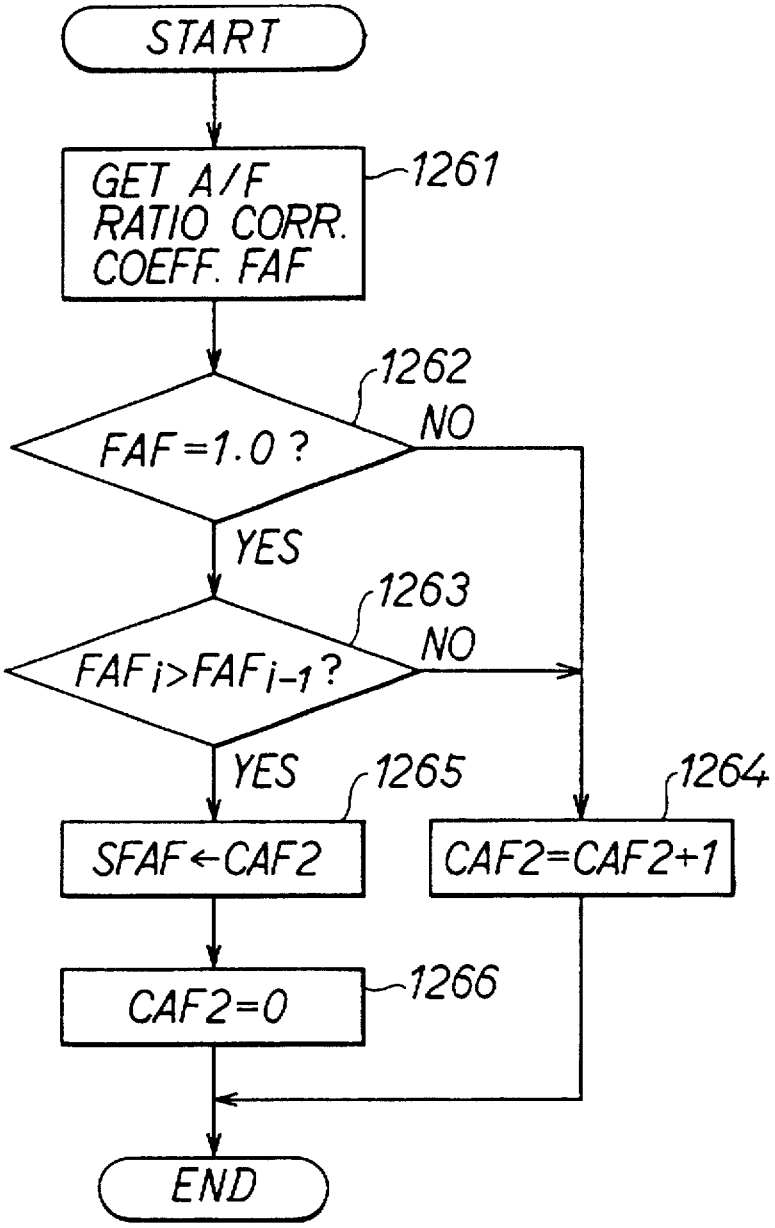
FIG. 20 is a flowchart illustrating a routine for calculating the oscillation period of air-fuel ratio correction coefficient.

In Step 1261 in FIG. 20, the CPU 42 reads in the air-fuel ratio correction coefficient FAF. The CPU then determines in Step 1262 whether the air-fuel ratio correction coefficient FAFλ is 1.0. Further, Step 1263 determines whether FAFi>FAFi−1. If either Step 1262 or Step 1263 makes a negative determination, the CPU 42 proceeds to Step 1264 to increment a period counter CAF2 by 1.

If both Step 1262 and Step 1263 make an affirmative determination, the CPU 42 proceeds to Step 1265 to store the value of the period counter CAF2 as the period SFAF of the air-fuel ratio correction coefficient FAF. Then, the CPU 42 clears the period counter CAF2 to "0" in Step 1266 and ends the routine. The period counter CAF2 operates as indicated in FIGS. 18E.

The procedure of calculating the amplitude Δλ of the air-fuel ratio λ and the amplitude ΔFAF of the air-fuel ratio correction coefficient FAF read by the CPU 42 in Steps 1216 and 1217 will be described with reference to the flowcharts shown in FIGS. 21 and 22.

Figure 21:
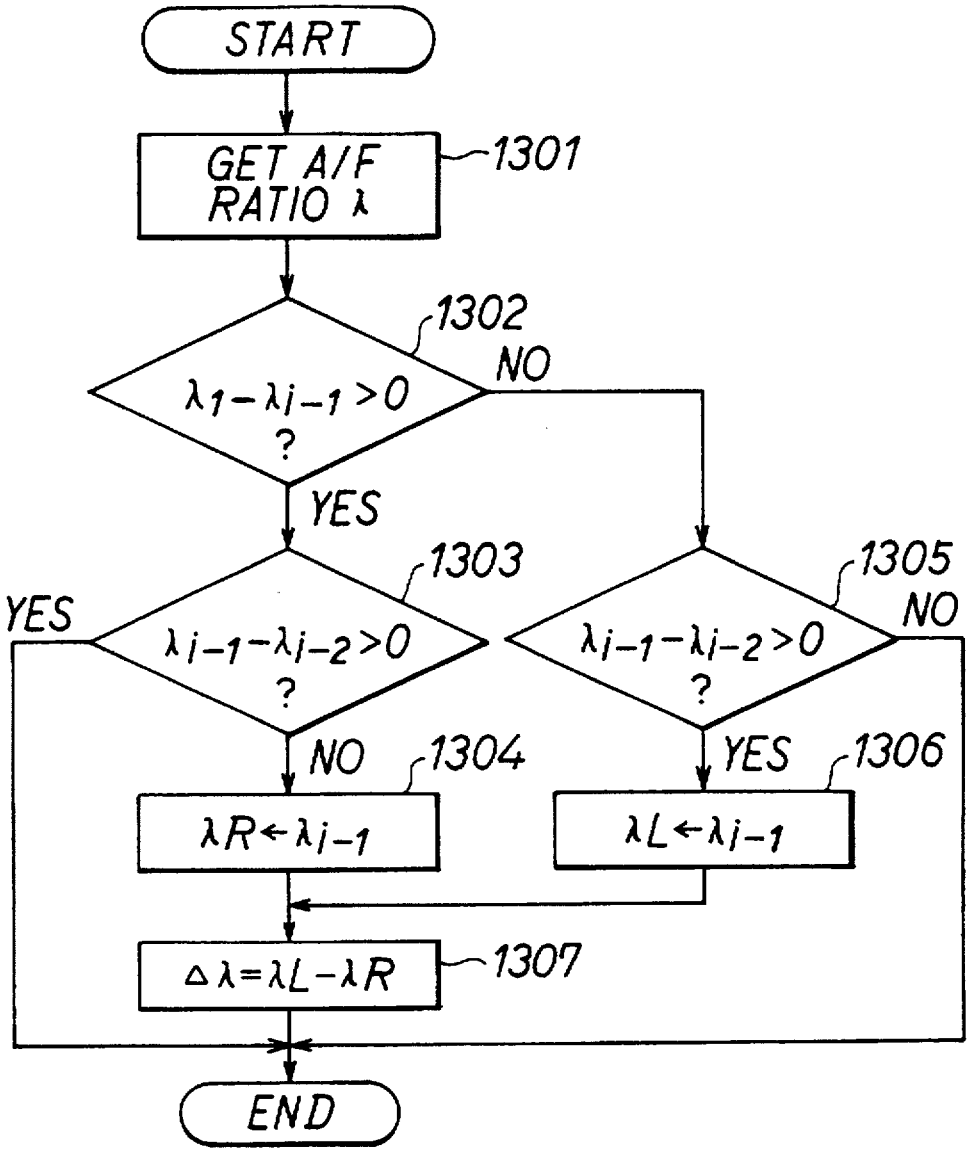
FIG. 21 is a flowchart illustrating a routine for calculating the amplitude of air-fuel ratio.
Figure 23A:
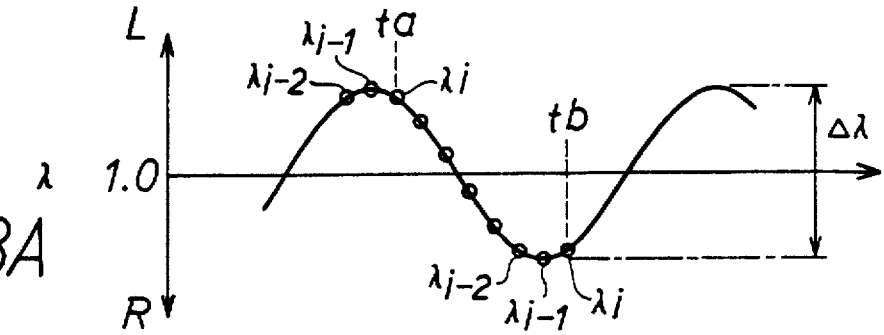
FIGS. 23A and 23B are timing charts for additional illustration of the operation shown in FIGS. 21 and 22.
Figure 23B:
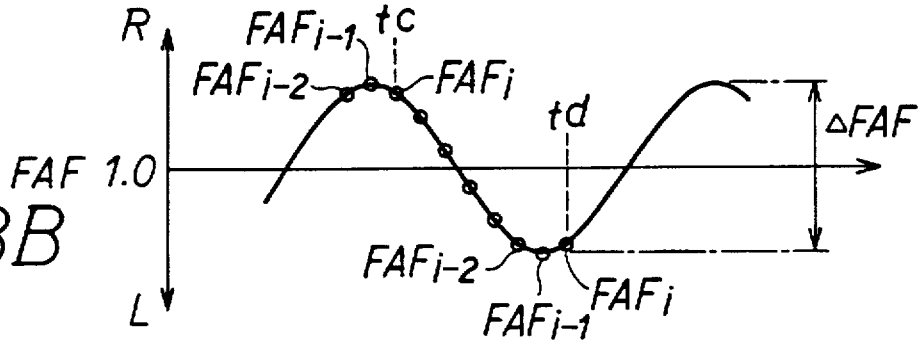

In Step 1301 in FIG. 21, the CPU 42 reads in the air-fuel ratio λ calculated on the basis of the detection by the air-fuel ratio sensor 26. The CPU 42 then determines in Step 1302 whether the value obtained by subtracting the last air-fuel ratio λi−1 from the present air-fuel ratio λi is positive, that is, whether λi−λi−1>0. If λi−λi−1>0, the CPU proceeds to Step 1303 to determine whether the value obtained by subtracting the air-fuel ratio λi−2 preceding the last reading from the last air-fuel ratio λi−1 is positive, that is, whether λi−1−λi−2>0. The combination of an affirmative determination in Step 1302 and a negative determination in Step 1303 means that the air-fuel ratio λ has, passed the rich peak and reversed its direction of change. In this case, the CPU 42 stores the last air-fuel ratio λi−1 as the rich peak λR in Step 1304. That is, the serial procedure of Steps 1301, 1302, 1303 and 1304 determines the rich peak λR of the air-fuel ratio λ at a time point tb indicated in FIGS. 23A and 23B.

If Step 1302 determines that λi−λi−1≦0, the CPU 42 proceeds to Step 1305 to determine whether the value obtained by subtracting the air-fuel ratio λi−2 preceding the last reading from the last air-fuel ratio λi−1 is positive, that is, whether λi−1−λi−2>0. The combination of a negative determination in Step 1302 and an affirmative determination in 305 means that the air-fuel ratio λ has passed the lean peak and reversed its direction of change. In this case, the CPU 42 stores the last air-fuel ratio λi−1 as the lean peak λL in Step 1306. That is, the serial procedure of Steps 1301, 1302, 1305 and 1306 determines the lean peak λL of the air-fuel ratio λ at a time point ta indicated in FIGS. 23A and 23B.

Then, the CPU 42 subtracts the rich peak λR from the lean peak λL to determine the amplitude Δλ of the air-fuel ratio λ (Δλ=λL−λR) in Step 1307 and then ends the routine. The amplitude ΔFAF of the air-fuel ratio correction coefficient FAF is calculated by a procedure similar to that of FIG. 21. This procedure will be described with reference to FIG. 22.

Figure 22:
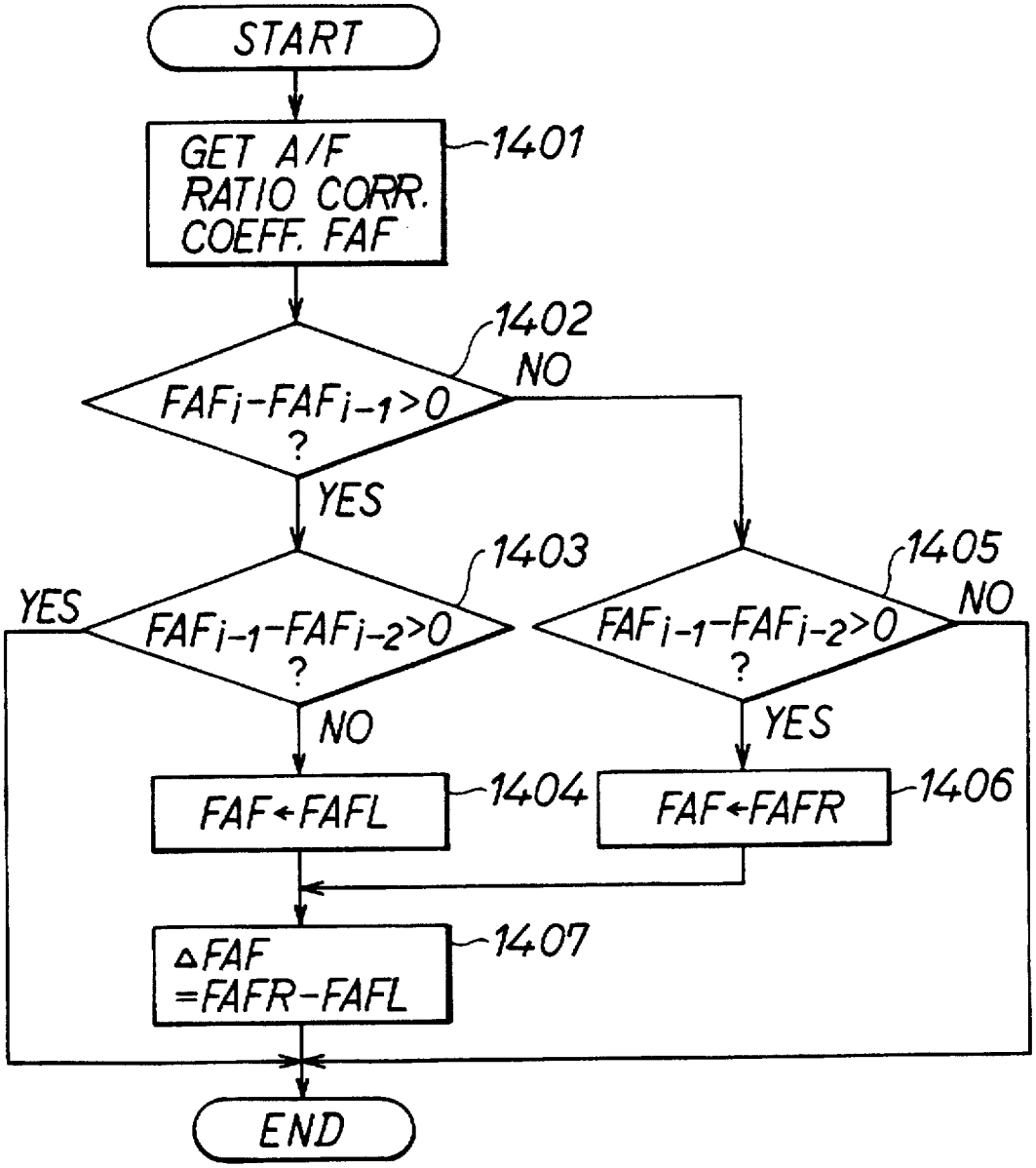
FIG. 22 is a flowchart illustrating a routine for calculating the amplitude of air-fuel ratio correction coefficient.

In Step 1401 in FIG. 22, the CPU 42 reads in the air-fuel ratio correction coefficient FAF. The CPU 42 then determines in Step 1402 whether FAFi−FAFi−1>0. If FAFi−FAFi−1>0, the CPU proceeds to Step 1403 to determine whether FAFi−1−FAFi−2>0. The combination of an affirmative determination in Step 1402 and a negative determination in Step 1403 means that the air-fuel ratio correction coefficient FAF has passed the lean peak and reversed its direction of change. In this case, the CPU 42 stores FAFi−1 as the lean peak FAFL in Step 1404. That is, the serial procedure of Steps 1401, 1402, 1403 and 1404 determines the lean peak FAFL of the air-fuel ratio correction coefficient FAF at a time point td indicated in FIGS. 23A and 23B.

If Step 1402 determines that FAFi−FAFi−1≦0, the CPU 42 proceeds to Step 1405 to determine whether FAFi−1−FAFi−2>0. The combination of a negative determination in Step 1402 and an affirmative determination in 405 means that the air-fuel ratio correction coefficient FAF has passed the rich peak and reversed its direction of change. In this case, the CPU 42 stores FAFi−1 as the rich peak FAFR in Step 1406. That is, the serial procedure of Steps 1401, 1402, 1405 and 1406 determines the rich peak FAFR of the air-fuel ratio correction coefficient FAF at a time point tc indicated in FIGS. 25A and 25B.

Then, the CPU 42 subtracts the lean peak FAFL from the rich peak FAFR to determine the amplitude ΔFAF of the air-fuel ratio correction coefficient FAF (ΔFAF=FAFR−FAFL) in Step 1407 and ends the routine.

Figure 24:
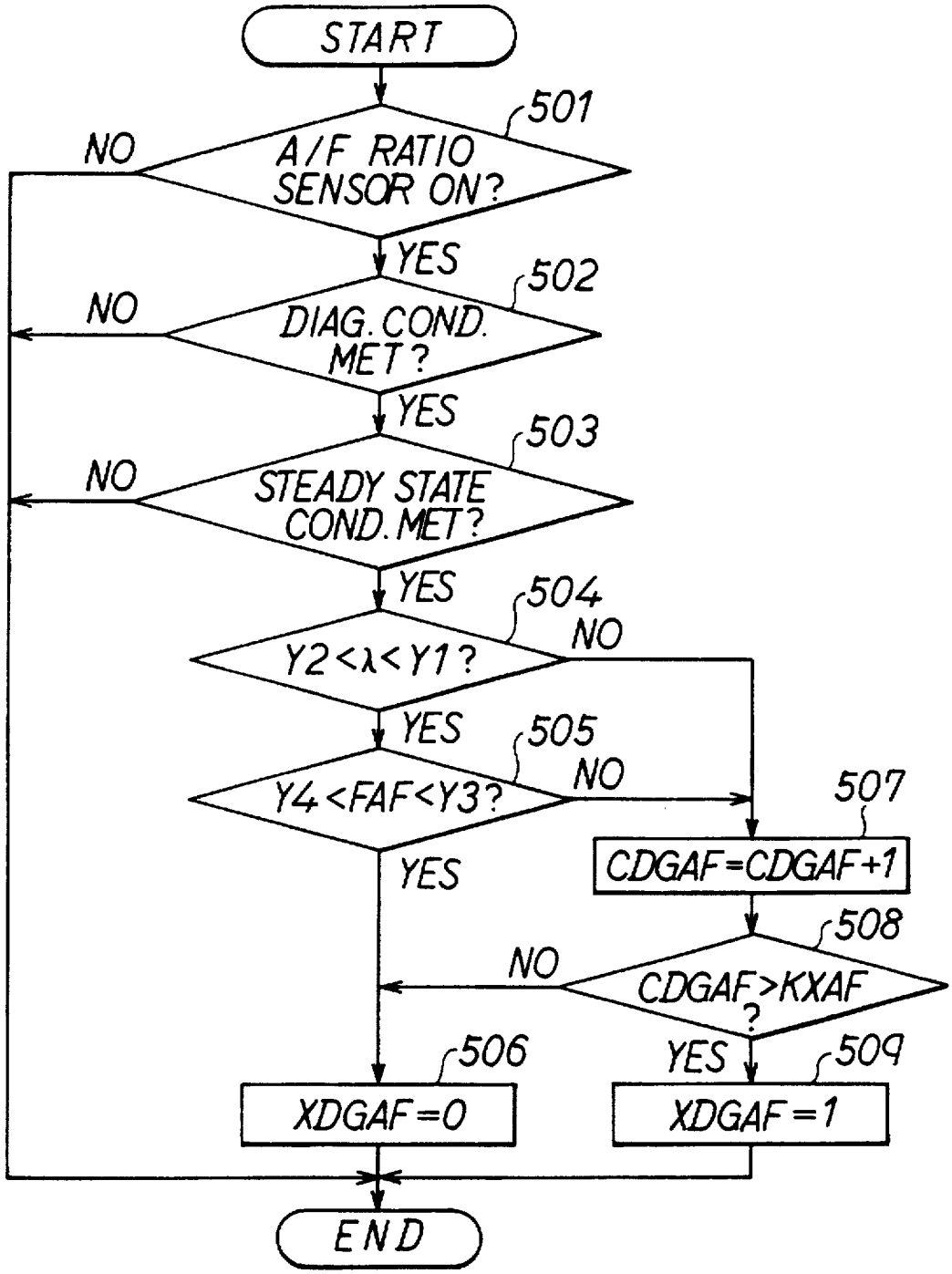
FIG. 24 is a flowchart illustrating a second sensor diagnosis routine.

The flowchart shown in FIG. 24 illustrates the second diagnosis routine executed by the CPU 42. This routine determines whether the form of abnormality as indicated in FIGS. 15F or 15G has occurred. This routine is executed, for example, immediately after the routine shown in FIGS. 17A and 17B.

Referring to FIG. 24, the CPU 42 determines whether the preconditions for the diagnosis have been established in Steps 501–503. The determination regarding the preconditions corresponds to Steps 1201–1203 described above, and will not be described again.

If the preconditions have been met, the CPU 42 proceeds to Step 1504 to determine whether the air-fuel ratio λ calculated on the basis of the detection by the air-fuel ratio sensor 26 is within a predetermined allowed range (Y2−Y1 indicated in FIG. 15F). If Step 1504 makes affirmative determination, the CPU 42 determines in Step 1505 whether the air-fuel ratio correction coefficient FAF is within a predetermined allowed range (Y3−Y4 indicated in FIG. 15G). If both Step 1504 and Step 1505 make an affirmative determination, the CPU 42 proceeds to Step 1506 to clear the abnormality determination flag XDGAF to "0", and then ends the routine.

If either Step 1504 or Step 1505 makes a negative determination, the CPU 42 proceeds to Step 1507 to increment the abnormality determination counter CDGAF by 1. In the case where the abnormality determination counter CDGAF exceeds a predetermined criterion KXAF (Yes in Step 1508), the CPU 42 proceeds to Step 1509 to set the abnormality determination flag XDGAF to "1".

As described above, this embodiment readily performs sensor diagnosis by making determination separately for various forms of abnormality of the air-fuel ratio sensor 26, thus improving the control precision of the air-fuel ratio control system. In addition, since this embodiment permits a diagnosis operation only upon a precondition that a predetermined length of time has elapsed following the start of the air-fuel ratio feedback (Step 1202 in FIG. 17A), the diagnosis is performed when symptoms of abnormality are likely to be distinguished. Thus, highly reliable diagnosis is made possible.

Although this embodiment performs the first and second sensor diagnosis routines with respect to the four types of abnormalities, diagnosis routines may be provided separately for each of the types of abnormalities (indicated in FIGS. 15B–15G). In this case, it is also possible to provide the individual routines with different operating cycles in accordance with the priority or incidence of the corresponding forms of abnormalities.

Fifth Embodiment

A fifth embodiment in which the diagnosis procedure for the phase deviation abnormality is modified will be described.

Figure 25:
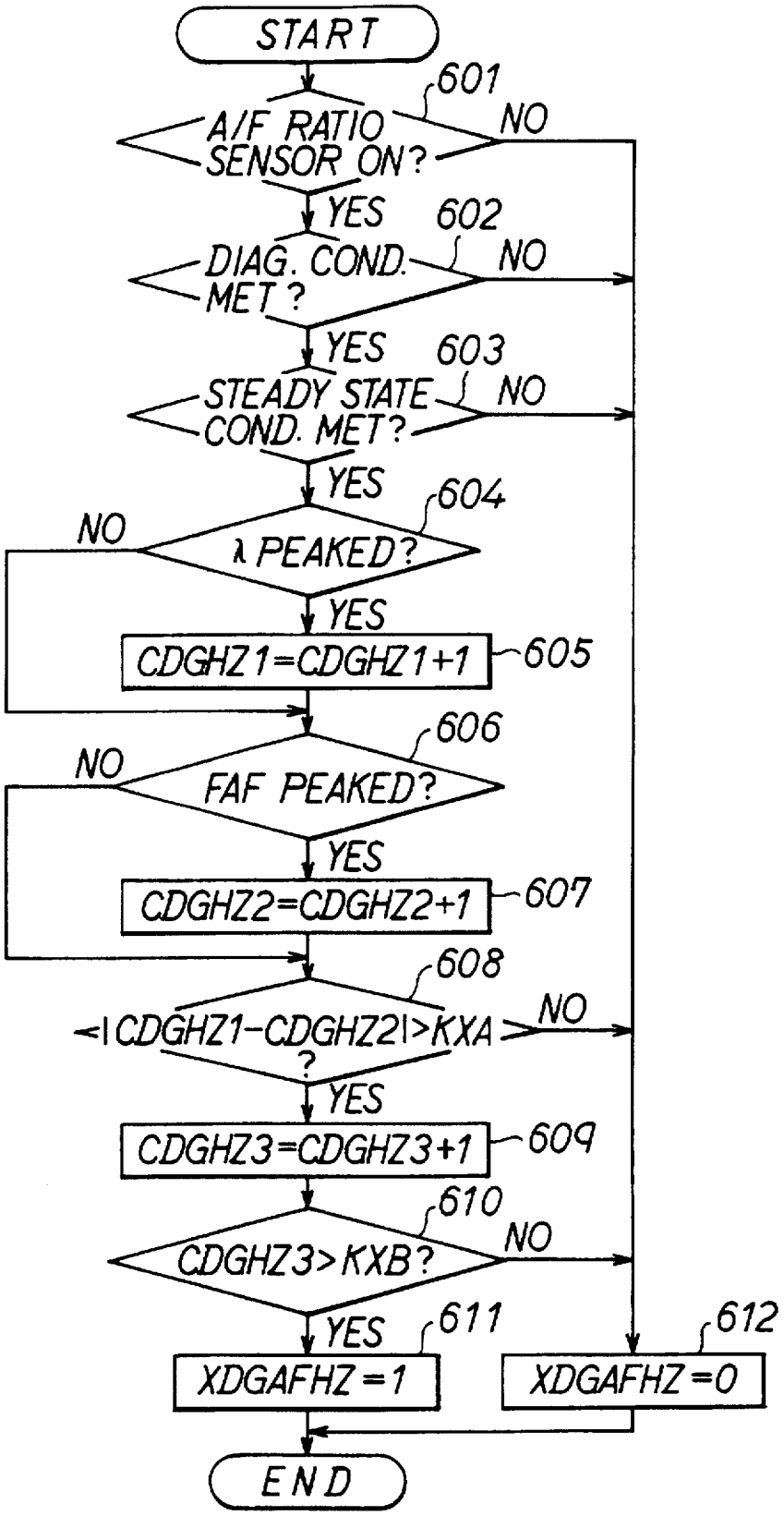
FIG. 25 is a flowchart illustrating a sensor diagnosis routine according to the second embodiment.

The flowchart shown in FIG. 25 illustrates a diagnosis routine according to the fifth embodiment.

Referring to FIG. 25, the CPU 42 determines whether the preconditions for the diagnosis have been established in Steps 601–603. The determination regarding the preconditions corresponds to Steps 1201–1203 described above, and will not be described again.

If the preconditions have been met, the CPU 42 proceeds to Step 604 to determine whether the air-fuel ratio λ has reached a peak value (either the lean peak or the rich peak). If the air-fuel ratio λ has reached a peak value, the CPU 42 increments a counter CDGHZ1 by 1. More specifically, the determination in Step 604 is based on the difference between the present value of the air-fuel ratio λ and the last value and the difference between the last value and the value preceding the last value as described with the flowchart shown in FIG. 21 (see the timing charts of FIGS. 23A and 23B).

Then, the CPU 42 determines in Step 606 whether the air-fuel ratio correction coefficient FAF has reached a peak value (either the rich peak or the lean peak). If the air-fuel ratio correction coefficient FAF has reached a peak value, the CPU 42 increments a counter CDGHZ2 by 1. The determination in Step 606 is based on the difference between the present value of the air-fuel ratio correction coefficient FAF and the last value and the difference between the last value and the value preceding the last value as described with the flowchart shown in FIG. 21 (see the timing charts of FIGS. 25A and 25B).

Subsequently, the CPU 42 determines in Step 608 whether the difference between the counters CDGHZ1 and CDGHZ2 exceeds a predetermined criterion KXA. If $|CDGHZ1-CDGHZ2| \leqq KXA$, then the CPU 42 determines that no abnormal phase deviation has occurred and proceeds to Step 612 to clear an abnormality determination flag XDGAFHZ to "0". If $|CDGHZ1-CDGHZ2| > KXA$, then the CPU 42 determines that an abnormal phase deviation has occurred, and proceeds to Step 609 to increment an abnormality determination counter CDGHZ3 by 1. In the case where the abnormality determination counter CDGHZ3 exceeds a predetermined criterion KXB (Yes in Step 610), that is, where an abnormality of the sensor 26 has been determined a predetermined number of times or more, the CPU 42 determines that an abnormality has definitely occurred in the air-fuel ratio sensor 26. The CPU 42 then proceeds to Step 611 to set the abnormality determination flag XDGAFHZ to "1".

As described above, this embodiment executes precise diagnosis even if the amplitude center of the air-fuel ratio λ (i.e., the output from the sensor 26) or the air-fuel ratio correction coefficient FAF shifts to the lean or rich side to a large extent. In a lean burn engine wherein combustion is conducted in the lean region, the amplitude center of the output from the air-fuel ratio sensor 26 shifts to the lean side to a large extent. In addition, if the result of learning of the air-fuel ratio is reflected in the air-fuel ratio control, the amplitude center of the air-fuel ratio correction coefficient FAF is shifted from the reference value (1.0). In these cases, the phase of the output from the sensor 26 and/or the air-fuel ratio correction coefficient FAF can be precisely determined without being affected by the lean burn or the air-fuel ratio learning by calculating the phase based on the interval between the peaks. Thus, this embodiment performs appropriate diagnosis operations.

Sixth Embodiment

Figure 26:
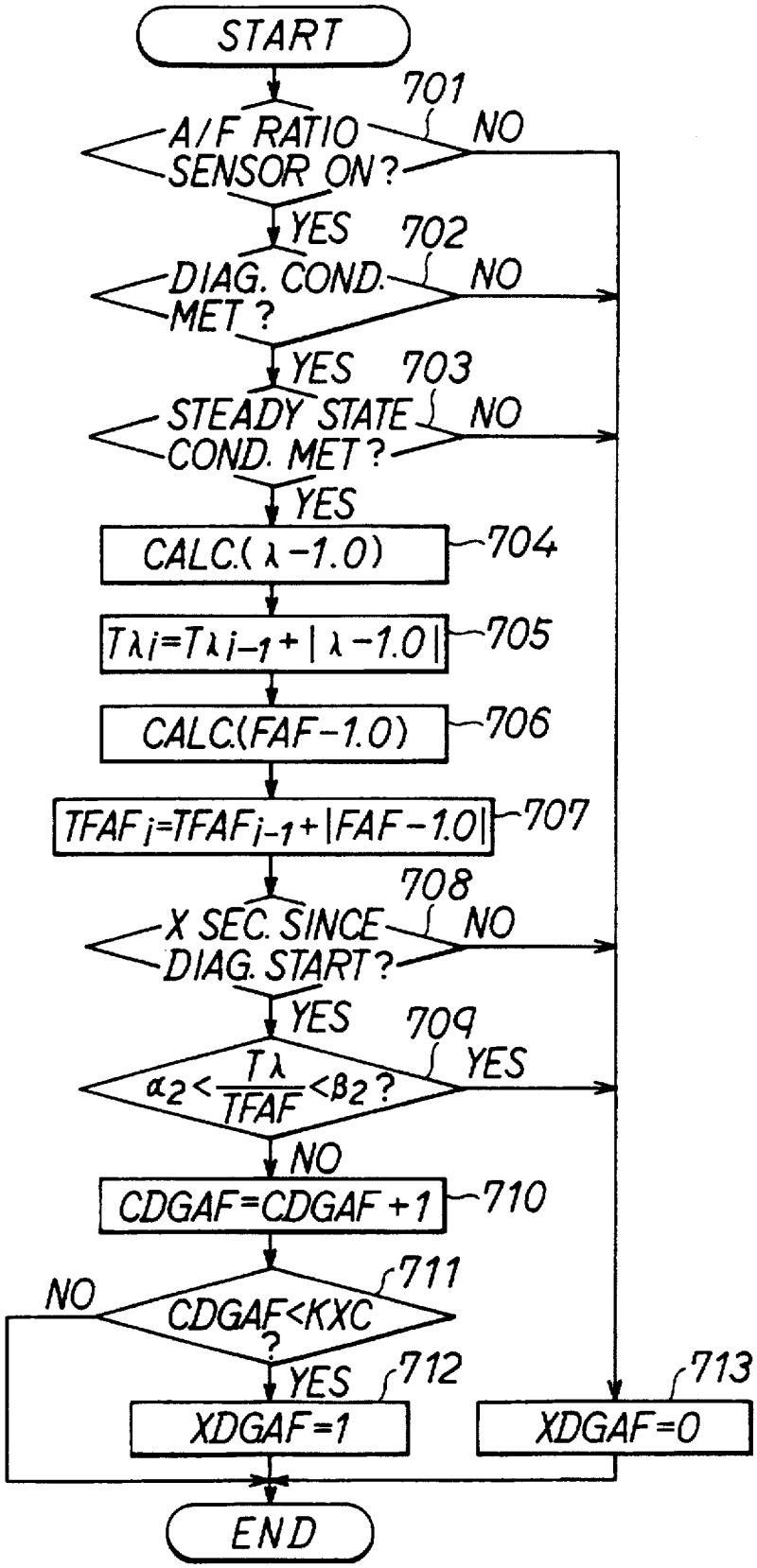
FIG. 26 is a flowchart illustrating a sensor diagnosis routine according to the third embodiment of the present invention.

A sixth embodiment of the present invention will be described below. The flowchart shown in FIG. 26 illustrates a sensor diagnosis routine according to the sixth embodiment. According to this embodiment, the CPU 42 provided in the ECU 41 constitutes first deviation accumulating means and second deviation accumulating means.

Referring to FIG. 26, the CPU 42 determines whether the preconditions for the diagnosis have been established in Steps 701–703. The determination regarding the preconditions corresponds to Steps 1201–1203 described above, and will not be described again. If the preconditions have been met, the CPU 42 proceeds to Step 704 to determine the difference between the air-fuel ratio λ and the target air-fuel ratio (=1.0 according to this embodiment), and in Step 705 calculates an accumulation Tλ by successively accumulating the difference between the air-fuel ratio λ and the target air-fuel ratio ($T\lambda i = T\lambda i-1 + |\lambda - 1.0|$). The CPU 42 then calculates a difference $|FAF-1.0|$ in Step 706, and calculates an accumulation TFAF by successively accumulating the difference $|FAF-1.0|$ ($TFAF = TFAFi-1 + |FAF-1.0|$).

Subsequently, the CPU 42 determines in Step 708 whether a duration of x seconds has elapsed following the starting of the diagnosis. If the duration of x seconds has elapsed, Step 709 calculates the ratio between the accumulation Tλ and the accumulation TFAF, and determines whether the ratio is within a predetermined allowed range (α2–α3) (for example, α2=0.8, β2=1.2). If Step 709 makes an affirmative determination, which means that no sensor abnormality has occurred, the CPU 42 proceeds to Step 713 to clear the abnormality determination flag XDGAF to "0".

If Step 709 makes a negative determination, which means that a sensor abnormality has occurred, the CPU 42 proceeds to Step 710 to increment the abnormality counter CDGAF by 1. In the case where the abnormality counter CDGAF exceeds a predetermined criterion KXC (YES in Step 711), the CPU 42 sets the abnormality determination flag XDGAF to "1".

Figure 27A:
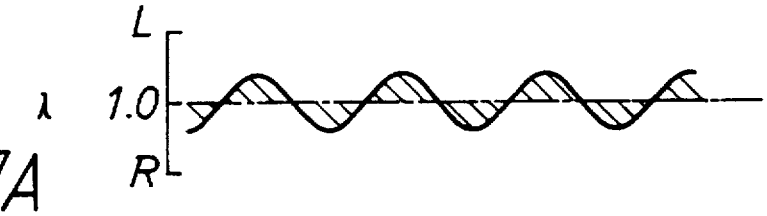
FIGS. 27A and 27B are timing chart for additional illustration of the operation shown in FIG. 26.
Figure 27B:
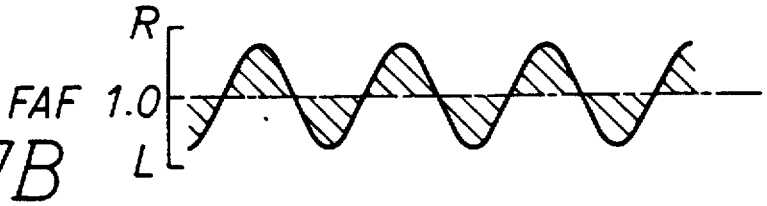

This embodiment performs diagnosis, as indicated in FIGS. 27A and 27B, in accordance with the ratio between the total of the amplitudes of the air-fuel ratio λ (the shadowed area) and the total of the amplitudes of the air-fuel ratio correction coefficient FAF (the shadowed area); that is, the ratio of the integrals of the two curves. In the amplitude abnormality indicated in FIG. 27B, $T\lambda/TFAF < \alpha 2$ is established and, therefore, the occurrence of an abnormality is determined.

As described above, this embodiment determines the occurrence of an amplitude abnormality by accumulating the differences between the air-fuel ratio λ and the target air-fuel ratio λTG and the differences between the air-fuel ratio correction coefficient FAF and the reference value (=1.0), respectively, and comparing the accumulated values. The diagnosis based on the accumulations makes it possible to perform a diagnosis that is hardly affected by external disturbances, such as temporary fluctuations of the sensor output or correction coefficients.

Seventh Embodiment

A seventh embodiment comprising a routine for performing diagnosis based on the deviation in phase of the air-fuel ratio λ from the air-fuel ratio correction coefficient FAF as well as the sensor diagnosis routine according to the seventh embodiment will be described below.

Figure 28A:
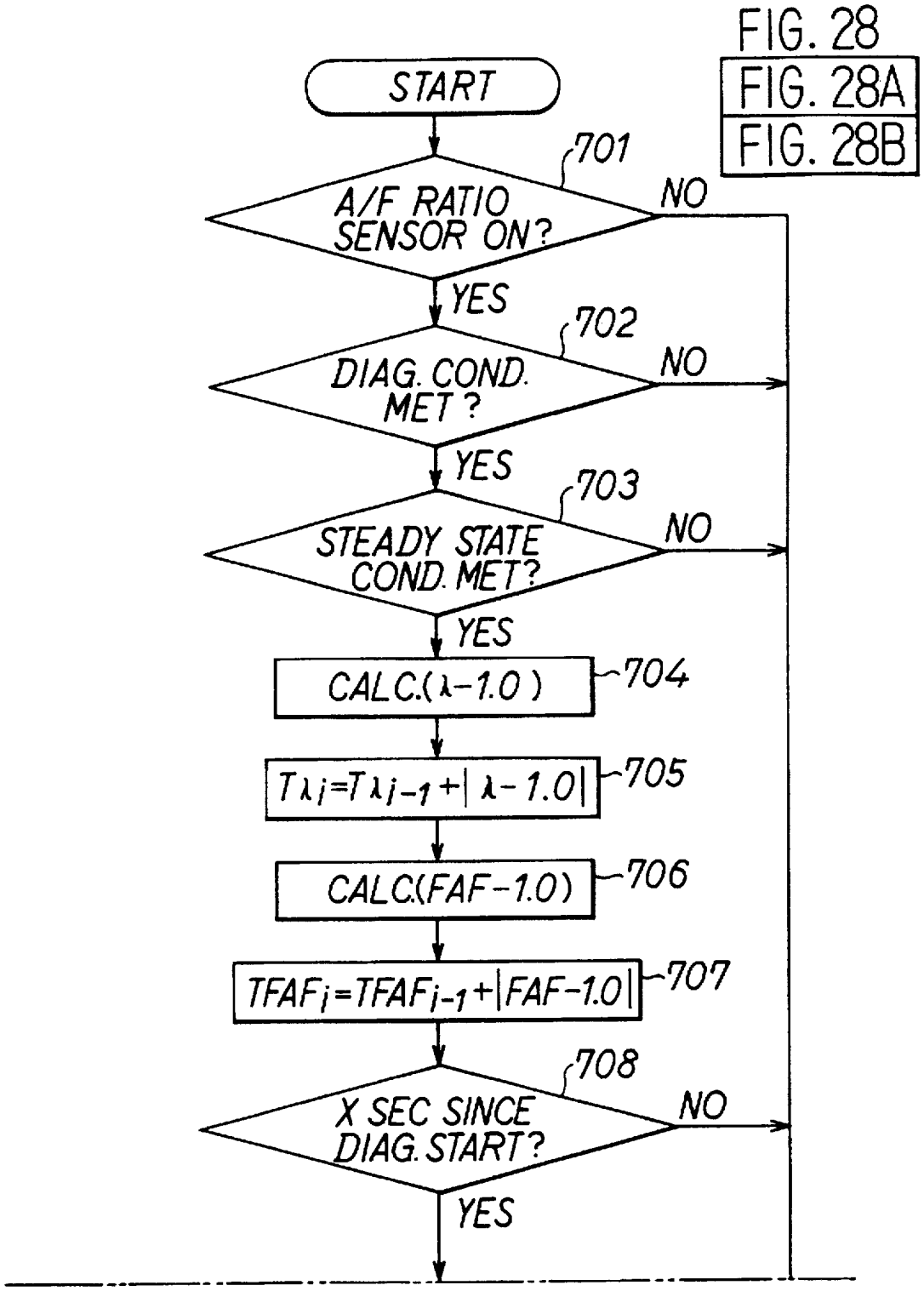
Figure 28B:
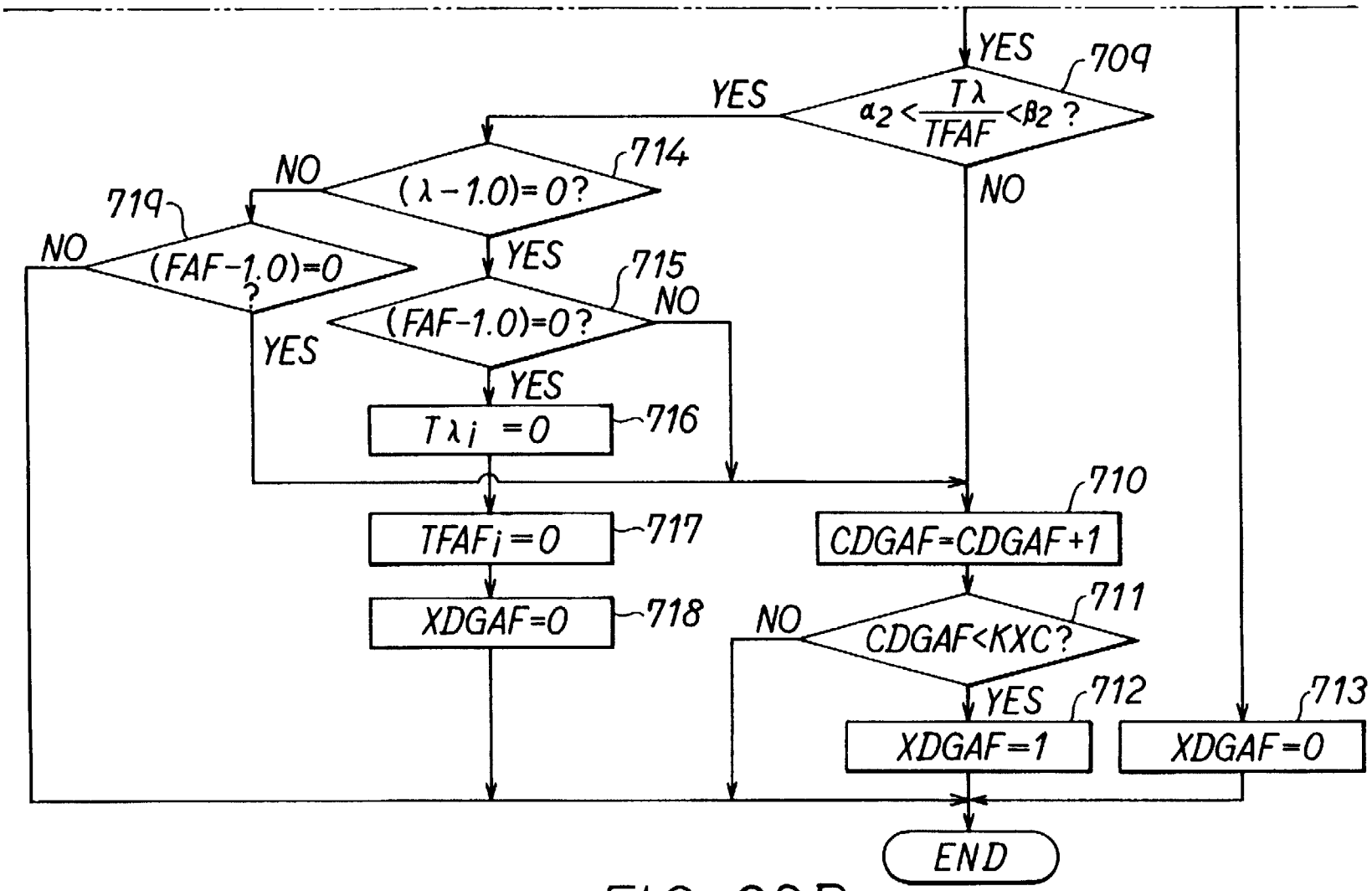

FIGS. 28A and 28B show a flowchart illustrating the phase deviation determining routine that is added to the flowchart shown in FIG. 26. According to this embodiment, deviation in phase is detected by a routine simplified from the phase deviation determining routine according to the fourth embodiment. This simplified routine will be described with reference to the flowchart of FIG. 28A and 28B.

If the operation proceeds to Step 709 and Step 709 makes affirmative determination, the CPU 42 proceeds to Step 714 to determine whether the air-fuel ratio λ is the theoretical air-fuel ratio. If the air-fuel ratio λ is the theoretical air-fuel ratio, the CPU 42 proceeds to Step 715 to determine whether the air-fuel ratio correction coefficient FAF indicates the theoretical air-fuel ratio (i.e., whether FAF is 1.0). If Step 715 makes an affirmative determination, it is determined that no phase deviation has occurred and that the air-fuel ratio sensor 26 is normal. Then, Step 716 clears the accumulation Tλi of the air-fuel ratio 1. Step 717 then clears the accumulation TFAFi of the air-fuel ratio correction coefficients FAF. Finally, Step 718 resets the abnormality determination flag XDGAF to "0", and the routine ends.

On the other hand, if Step 714 makes a negative determination, the CPU 42 proceeds to Step 719 to determine whether the air-fuel ratio correction coefficient FAF indicates the theoretical air-fuel ratio (whether FAF is 1.0) as in Step 715. If Step 719 makes a negative determination, it is impossible to determine whether a phase deviation has occurred, and therefore the CPU 42 ends the routine. If Step 719 makes an affirmative determination, it is determined that a phase deviation has occurred, and the CPU 42 executes the procedure from Step 710 to the end. If Step 715 makes a negative determination, it is determined that a phase deviation has occurred, and the CPU 42 executes the procedure from Step 710 to the end.

The procedure in Step 714, Step 715 or Step 719 makes a determination based on whether the air-fuel ratio λ is the theoretical air-fuel ratio or whether the air-fuel ratio correction coefficient FAF indicates the theoretical air-fuel ratio according to this embodiment. However, considering the response delay by the processing of sensor signals, some latitude may be allowed. For example, although Step 714 determines whether the air-fuel ratio indicates or corresponds to the theoretical air-fuel ratio on the basis of whether $\lambda-1.0=0$, this determination may be based on whether $-0.025 \leqq (\lambda-1) \leqq 0.025$. Such latitude may also be allowed for Steps 715 and 719.

Besides the embodiments described above, the present invention may be implemented, for example, as follows:

(1) Although, according to the above-described embodiments, the sensor diagnosis of the present invention is embodied in an air-fuel ratio control system that uses a modern control theory to achieve air-fuel ratio feedback control, the sensor diagnosis operation of the invention may be embodied in other systems performing other types of control such as PID control and the like.

(2) Although, according to the embodiments, the diagnosis operation of the invention is implemented for increasing correction (the coolant temperature-dependent increasing control, the high-load increasing control), the diagnosis operation of the invention may also be embodied for reducing correction. For example, in an air-fuel ratio control system comprising an evaporation purge mechanism for purging evaporated fuel from a fuel tank into an intake system of an internal combustion engine, the amount of fuel to be injected from the fuel injection valve 7 is corrected to a reduced amount in accordance with the amount of evaporated fuel purged into the intake system. If the diagnosis operation of the invention is embodied in such a system, abnormality of the air-fuel ratio sensor will be detected on the basis of the change of the air-fuel ratio λ outputted from the air-fuel ratio sensor during the reducing correction.

(3) Although the above-described embodiments use the elapse of a predetermined length of time following the start of the air-fuel ratio feedback as a precondition for starting the diagnosis operation, this precondition may be changed to the elapse of a predetermined length of time following the start of the engine (switching-on of the power). Furthermore, this precondition may also be omitted.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A diagnostic apparatus for an air-fuel ratio sensor, said apparatus comprising:

an air-fuel ratio sensor which can vary its output linearly when detecting an air-fuel ratio in an internal combustion engine;

transitional state determining means for determining when operation of the engine is in a transitional state;

characteristic detecting means for detecting a characteristic of the air-fuel ratio detected by the air-fuel ratio sensor; and sensor diagnostic means for, when the transitional state determining means determines that the operation of the engine is in the transitional state, checking for an abnormality of the air-fuel ratio sensor based on the characteristic detected by the characteristic detecting means.

2. The apparatus of claim 1, wherein said characteristic detecting means is for detecting an amplitude of the air-fuel ratio detected by the air-fuel ratio sensor.

3. The apparatus of claim 1, wherein said transitional state determining means determines that the engine is in a transitional state based on one of an acceleration state of the engine, an amount of change of the air-fuel ratio, and an amount of change of an air-fuel ratio correction coefficient of the engine.

4. The apparatus of claim 1, wherein the sensor diagnostic means is for checking for abnormality of the air-fuel ratio sensor based on a difference in peak rich and lean air-fuel ratios occurring while the engine is in the transitional state.

5. The apparatus of claim 4, wherein the sensor diagnostic means is for determining an abnormality of the air-fuel ratio sensor when the difference in peak ratios is less than a predetermined value.

* * * * *